US012727672B2

(12) United States Patent
Yoon et al.

(10) Patent No.: US 12,727,672 B2
(45) Date of Patent: Sep. 8, 2026

(54) WALL MOUNT FIXTURE AND DISPLAY APPARATUS HAVING THE SAME

(71) Applicant: Samsung Electronics Co., Ltd., Suwon-si (KR)

(72) Inventors: Daesik Yoon, Suwon-si (KR); Jungwon Min, Suwon-si (KR); Yonghwan Park, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 18/757,213

(22) Filed: Jun. 27, 2024

(65) Prior Publication Data

US 2025/0049215 A1 Feb. 13, 2025

Related U.S. Application Data

(63) Continuation of application No. PCT/KR2024/006121, filed on May 8, 2024.

(30) Foreign Application Priority Data

Aug. 10, 2023 (KR) ..... 10-2023-0104701

(51) Int. Cl.
*A47B 97/00* (2006.01)

(52) U.S. Cl.
CPC ..... *A47B 97/001* (2013.01)

(58) Field of Classification Search
CPC .... A47B 97/001; A47B 97/00; F16M 11/121; F16M 2200/021; F16M 2200/065; H04N 5/655

(Continued)

(56) References Cited

U.S. PATENT DOCUMENTS 2,233,548 A * 3/1941 Mroziak ..... H02G 3/125 220/3.9
4,363,459 A * 12/1982 Holzer ..... E06B 9/323 248/265

(Continued)

FOREIGN PATENT DOCUMENTS

CN 209949281 U 1/2020
CN 217335729 U 8/2022

(Continued)

OTHER PUBLICATIONS

Search Report and Written Opinion dated Aug. 28, 2024 issued in International Patent Application No. PCT/KR2024/006121.

(Continued)

*Primary Examiner* — Nkeisha Smith
(74) *Attorney, Agent, or Firm* — Nixon & Vanderhye P.C.

(57) ABSTRACT

A display apparatus may include: a display, a wall mount on which the display is mounted; and a wall mount fixture to which the wall mount is fixed. The wall mount fixture may include: an extension bracket to which the wall mount is fixed; a first bracket including a mounting plate mounted into a mounting groove formed on a wall and a protrusion protruding to an outside of the mounting groove on the mounting plate; a second bracket including a receiving portion configured to receive the protrusion and a fixing plate provided in front of the receiving portion to be fixed to the protrusion and to fix the extension bracket; and a support screw configured to be fastened to a lower portion of the protrusion and to support the protrusion inside the mounting groove.

14 Claims, 27 Drawing Sheets

(58) Field of Classification Search
USPC ..... 248/475.1
See application file for complete search history.

(56) References Cited

U.S. PATENT DOCUMENTS

| | | | | |
|---|---|---|---|---|
| 6,367,756 | B1 * | 4/2002 | Wang | F16M 11/2014 248/278.1 |
| 6,851,226 | B2 * | 2/2005 | MacGregor | F16M 11/041 52/239 |
| 7,316,379 | B1 * | 1/2008 | Graham | A47G 1/1606 248/495 |
| 7,513,474 | B2 * | 4/2009 | Anderson | F16M 11/10 248/922 |
| 7,975,976 | B2 * | 7/2011 | Wohlford | F16M 11/2014 52/27 |
| 8,827,226 | B2 * | 9/2014 | Townsend | F16M 11/2092 248/920 |
| 9,273,473 | B2 * | 3/2016 | Millson | F16M 13/02 |
| 9,383,060 | B2 * | 7/2016 | Geier | F16M 13/02 |
| 9,408,465 | B2 * | 8/2016 | Dowling | F16M 13/02 |
| 10,595,634 | B2 * | 3/2020 | Pei | F16M 11/24 |
| 11,105,458 | B2 * | 8/2021 | Runger | F16M 11/041 |
| 11,287,080 | B2 * | 3/2022 | Newville | F16M 11/046 |
| 2007/0041150 | A1 * | 2/2007 | Short | F16M 11/2014 361/679.22 |
| 2008/0054144 | A1 * | 3/2008 | Wohlford | F16M 11/08 248/231.91 |
| 2009/0032659 | A1 * | 2/2009 | Goldstein | A47H 13/01 248/220.21 |
| 2009/0173036 | A1 * | 7/2009 | Hand | E04B 2/96 52/715 |
| 2010/0149736 | A1 * | 6/2010 | Dittmer | F16M 13/02 361/679.01 |
| 2010/0224737 | A1 * | 9/2010 | LaFontaine | H04Q 1/023 248/65 |

FOREIGN PATENT DOCUMENTS

| | | | |
|---|---|---|---|
| JP | 4966148 | B2 | 4/2012 |
| KR | 10-2006-0032853 | | 4/2006 |
| KR | 10-0133993 | | 12/2010 |
| KR | 102068726 | B1 | 1/2020 |
| KR | 102138285 | B1 | 7/2020 |
| KR | 102144115 | B1 | 8/2020 |
| KR | 102220311 | B1 | 2/2021 |
| KR | 102259710 | B1 | 6/2021 |
| KR | 102267329 | B1 | 6/2021 |
| KR | 10-2289916 | | 8/2021 |
| KR | 102285123 | B1 | 8/2021 |
| KR | 102289916 | B1 | 8/2021 |
| KR | 102291158 | B1 | 8/2021 |
| KR | 102297187 | B1 | 9/2021 |
| KR | 102314739 | B1 | 10/2021 |
| KR | 102333789 | B1 | 12/2021 |
| KR | 20220020186 | A | 2/2022 |
| KR | 102372320 | B1 | 3/2022 |
| KR | 10-2398624 | | 5/2022 |
| KR | 102398624 | B1 | 5/2022 |
| KR | 102422323 | B1 | 7/2022 |
| KR | 102423033 | B1 | 7/2022 |
| KR | 102440055 | B1 | 9/2022 |
| KR | 102444536 | B1 | 9/2022 |
| KR | 20220126343 | A | 9/2022 |
| KR | 20220145068 | A | 10/2022 |
| KR | 102466801 | B1 | 11/2022 |
| KR | 102472437 | B1 | 11/2022 |
| KR | 102482474 | B1 | 12/2022 |
| KR | 20220166909 | A | 12/2022 |
| KR | 20230009762 | A | 1/2023 |
| KR | 102497490 | B1 | 2/2023 |
| KR | 10-2533319 | B1 | 5/2023 |
| KR | 10-2618111 | B1 | 12/2023 |
| KR | 10-2024-0002446 | A | 1/2024 |
| KR | 10-2725640 | | 11/2024 |

OTHER PUBLICATIONS

Korean Notice of Allowance issued Aug. 9, 2024 in corresponding Korean Patent Application No. 10-2023-0104701.

Extended European Search Report dated Jun. 12, 2026 for EP Application No. 24852008.2.

* cited by examiner

WALL MOUNT FIXTURE AND DISPLAY APPARATUS HAVING THE SAME

CROSS-REFERENCE TO RELATED APPLICATIONS

This application is a continuation of International Application No. PCT/KR2024/006121 designating the United States, filed on May 8, 2024, in the Korean Intellectual Property Receiving Office and claiming priority to Korean Patent Application No. 10-2023-0104701, filed on Aug. 10, 2023, in the Korean Intellectual Property Office, the disclosures or each of which are incorporated by reference herein in their entireties.

BACKGROUND

Field

The disclosure relates to a wall mount fixture to fix a wall mount on which a display is mounted, and a display apparatus having the same.

Description of Related Art

In general, a display apparatus is a device for displaying an image and includes a monitor and a television. The display apparatus may be divided into a self-luminous display panel such as an Organic Light Emitting Diode (OLED) and a light receiving display panel such as a Liquid Crystal Display (LCD).

The display apparatus may include a display for displaying an image, a support for supporting the display, and the like. Because a display is approximately plate-shaped, a stand may be used as a support for supporting a stand type display, and a wall mount may be used as a support for supporting a wall-mounted type display.

A display may be mounted on a wall mount, and a wall mount fixture for fixing the wall mount may be mounted on a wall. Accordingly, after mounting the wall mount fixture on the wall, the wall mount may be fixed to the wall mount fixture and the display may be mounted on the wall mount, thereby using the display on the wall.

SUMMARY

Embodiments of the disclosure may provide a wall mount fixture including a support screw for distributing a load of a display when the display is mounted on a wall mount, and a display apparatus having the same.

Embodiments of the disclosure may provide a wall mount fixture including a bracket mounted in a mounting groove and having a rectangular column shape to prevent and/or reduce a display from rotating by an external force when the display is mounted on a wall mount, and a display apparatus having the same.

Embodiments of the disclosure may provide a wall mount fixture in which a second bracket is fixed to a first bracket mounted in a mounting groove by a single screw to easily fix the second bracket to the first bracket, and a display apparatus having the same.

According to an example embodiment of the disclosure, a display apparatus may include: a display; a wall mount on which the display is configured to be mounted; and a wall mount fixture to which the wall mount is configured to be fixed. The wall mount fixture may include: an extension bracket to which the wall mount is configured to be fixed; a first bracket including a mounting plate mounted into a mounting groove provided on a wall and a protrusion protruding to an outside of the mounting groove on the mounting plate; a second bracket including a receiving portion configured to receive the protrusion and a fixing plate provided in front of the receiving portion and configured to be fixed to the protrusion and to fix the extension bracket; and a support screw configured to be fastened to a lower portion of the protrusion and to support the protrusion inside the mounting groove.

According to an example embodiment of the disclosure, a display apparatus may include: a display; a wall mount on which the display is configured to be mounted; and a wall mount fixture to which the wall mount is configured to be fixed. The wall mount fixture may include: an extension bracket to which the wall mount is configured to be fixed; a first bracket including a mounting plate mounted into a mounting groove formed on a wall and a protrusion protruding to an outside of the mounting groove on the mounting plate; a second bracket including a receiving portion configured to receive the protrusion and a fixing plate provided in front of the receiving portion configured to fix the extension bracket; and a support screw configured to support the protrusion inside the mounting groove, wherein the fixing plate may be fixed to the protrusion by a single screw.

According to an example embodiment of the disclosure, a wall mount fixture to which a wall mount on which a display is configured to be mounted is configured to be fixed may include: an extension bracket to which the wall mount is configured to be fixed; a first bracket including a mounting plate mounted into a mounting groove provided on a wall and a protrusion protruding to an outside of the mounting groove on the mounting plate; a second bracket including a receiving portion configured to receive the protrusion and a fixing plate provided in front of the receiving portion to be fixed to the protrusion and to fix the extension bracket; and a support screw configured to be fastened to a lower portion of the protrusion and to support the protrusion inside the mounting groove.

BRIEF DESCRIPTION OF THE DRAWINGS

The above and other aspects, features and advantages of certain embodiments of the present disclosure will be more apparent from the following detailed description, taken in conjunction with the accompanying drawings, in which.

DETAILED DESCRIPTION

Figure 1:
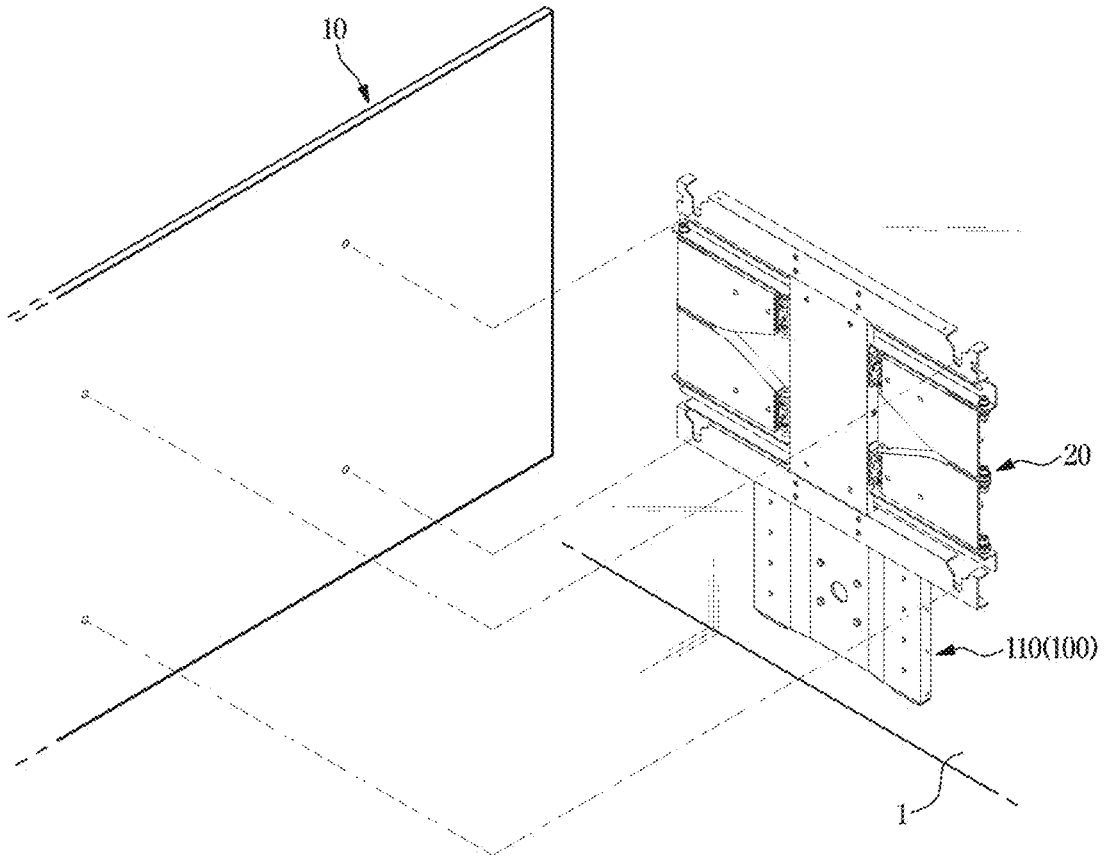
FIG. 1 is an exploded perspective view illustrating a display and a wall mount according to various embodiments.

Various example described herein and configurations shown in the accompanying drawings are merely examples of the disclosure, and various modifications may be made to the various embodiments and the drawings of the disclosure at the time of filing of the application.

Like reference numerals or symbols denoted in the drawings of the disclosure are members or components that perform the substantially same functions.

A singular form of a noun corresponding to an item may include one item or a plurality of the items unless context clearly indicates otherwise.

As used herein, each of the expressions "A or B," "at least one of A and B," "at least one of A or B," "A, B, or C," "at least one of A, B, and C," and "at least one of A, B, or C," may include one or all possible combinations of the items listed together with a corresponding expression among the expressions.

The term "and/or" includes any and all combinations of one or more of a plurality of associated listed items.

It will be understood that the terms "first", "second", etc., may be used only to distinguish one component from another, not intended to limit the corresponding component in other aspects (e.g., importance or order).

The terms "front," "rear," "top," "bottom," "side," "left," "right," "upper," "lower" etc., used in the following description are defined based on the drawings, and the shape and position of each component are not limited by these terms.

It will be understood that when the terms "includes," "comprises," "including," and/or "comprising," when used in this disclosure, specify the presence of stated features, figures, steps, operations, components, members, or combinations thereof, but do not preclude the presence or addition of one or more other features, figures, steps, operations, components, members, or combinations thereof.

An expression that one component is "connected", "coupled", "supported", or "in contact" with another component includes a case in which the components are directly "connected", "coupled", "supported", or "in contact" with each other and a case in which the components are indirectly "connected", "coupled", "supported", or "in contact" with each other through a third component.

It will also be understood that when one component is referred to as being "on" or "over" another component, it may be directly on the other component or intervening components may also be.

Hereinafter, various example embodiments of the disclosure are described in greater detail with reference to the accompanying drawings.

Figure 2:
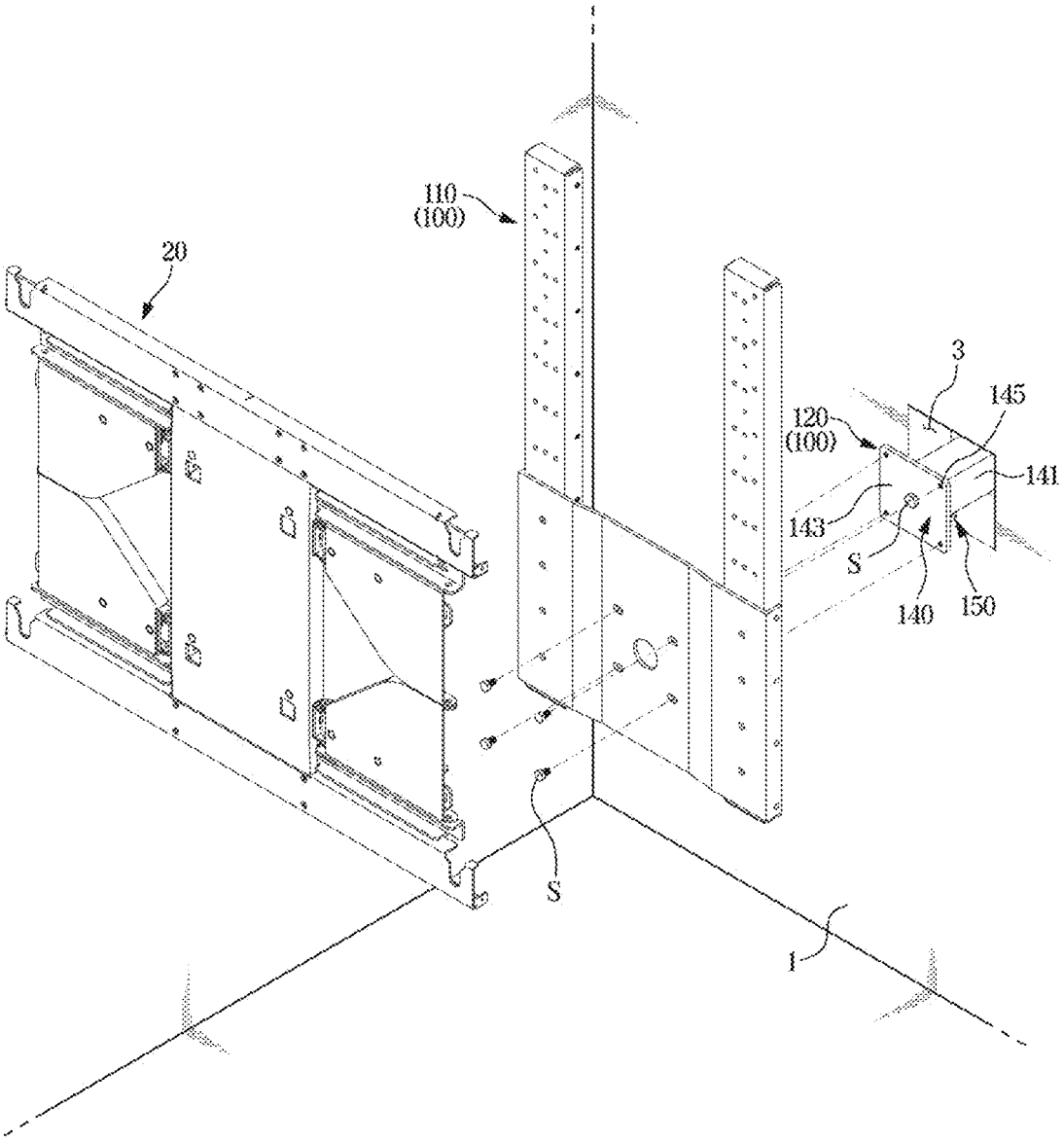
FIG. 2 is an exploded perspective view illustrating an extension bracket, a second bracket and a wall mount according to various embodiments.

FIG. 1 is an exploded perspective view illustrating a display mounted on a wall mount according to various embodiments. FIG. 2 is an exploded perspective view illustrating an extension bracket fixed to a second bracket and a wall mount fixed to the extension bracket according to various embodiments.

In the disclosure, a flat display apparatus is illustrated as an example. However, it will be understood by those skilled in the art that a display apparatus may be implemented as a curved display apparatus having a screen with a fixed curvature, and a curvature adjustable display apparatus that may change a curvature of a current screen by user input, without being limited thereto.

In the drawing, based on a mounting groove 3 formed on a wall 1, an open portion of the mounting groove 3 may be a forward direction, and an opposite direction thereof may be a backward direction.

As shown in FIG. 1 and FIG. 2, the display apparatus may include a display 10 displaying an image, a wall mount 20 on which the display 10 is mounted, and a wall mount fixture 100 to which the wall mount 20 is fixed.

The wall mount fixture 100 may include an extension bracket 110 to which the wall mount 20 is fixed. The wall mount fixture 100 may include a bracket 120 mounted in the mounting groove 3 formed on the wall 1. The mounting groove 3 may be a buried outlet space formed on the wall 1. The extension bracket 110 may be fixed to the bracket 120 mounted in the mounting groove 3 by a plurality of screws S. The extension bracket 110 may be fixed to a plurality of extension bracket fixing holes 145 formed in the bracket 120 by a plurality of screws S.

Figure 3:
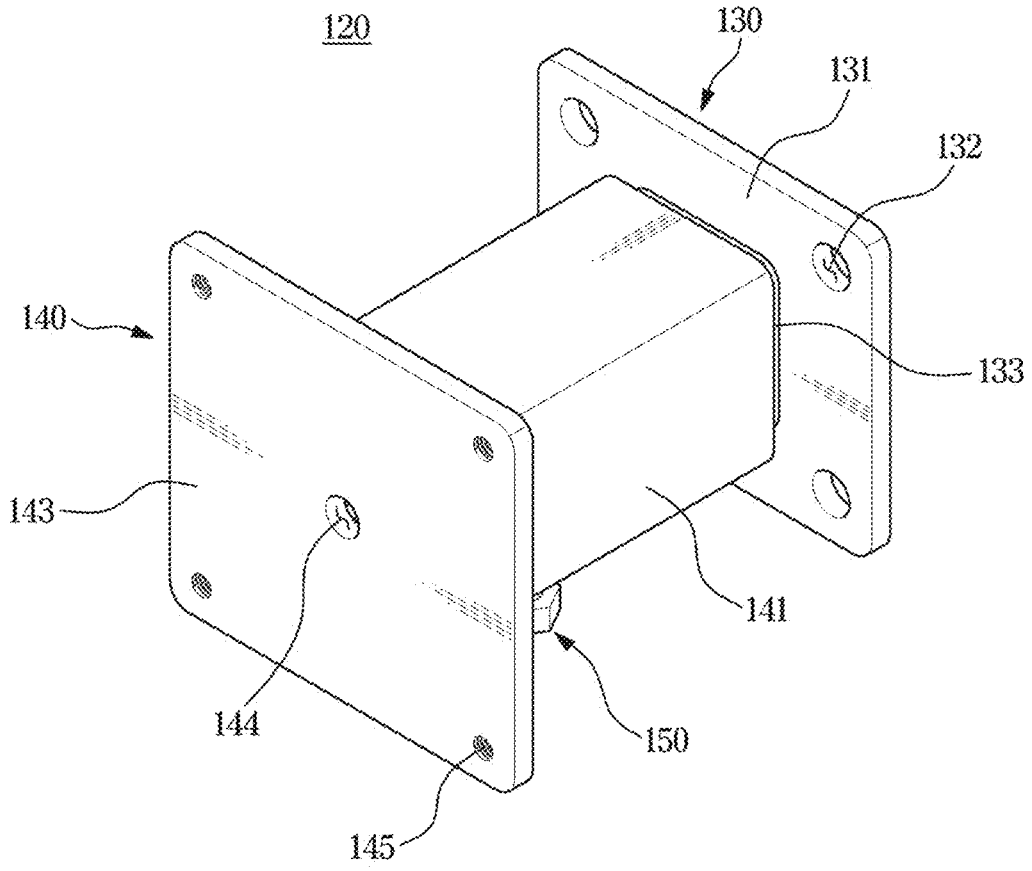
FIG. 3 is a perspective view illustrating a bracket according to various embodiments.
Figure 4:
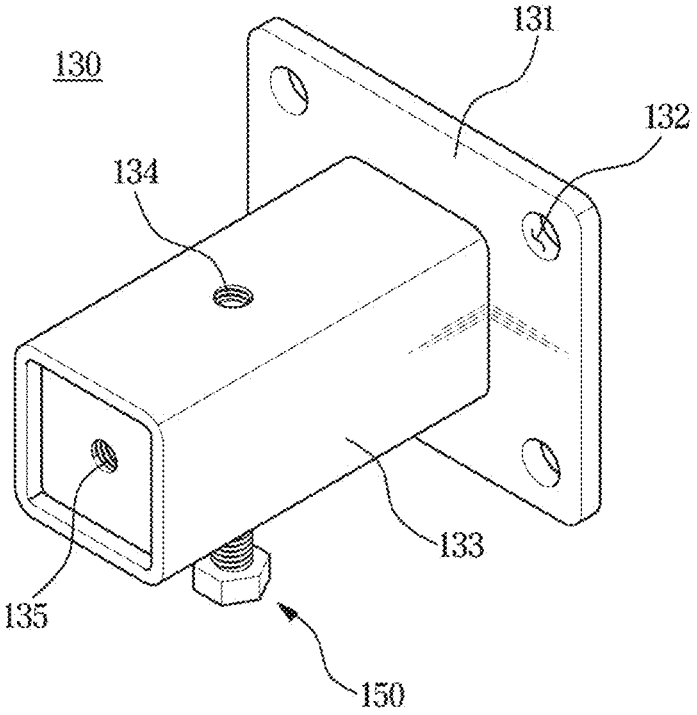
FIG. 4 is a perspective view illustrating a state in which a support screw is fastened to a first bracket according to various embodiments.
Figure 5:
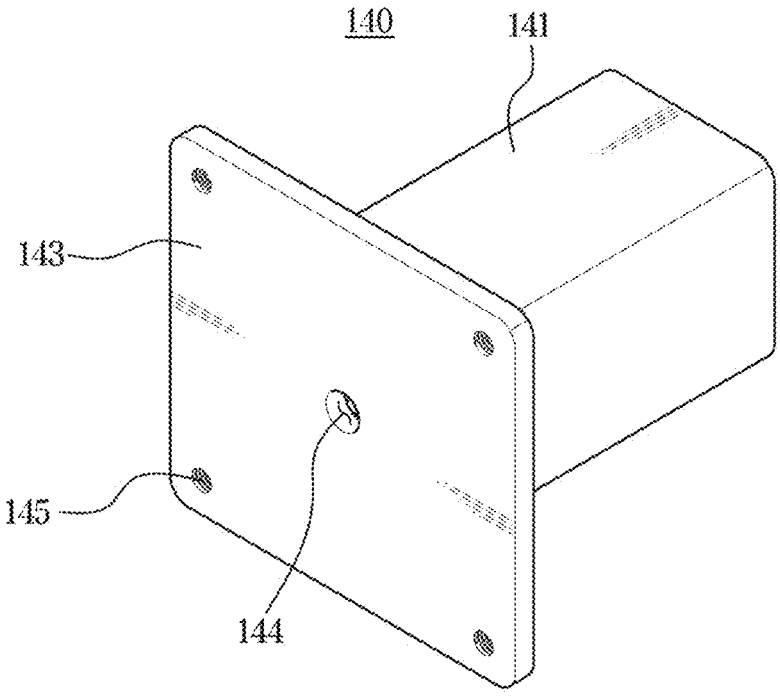
FIG. 5 is a perspective view illustrating a second bracket according to various embodiments
Figure 6:
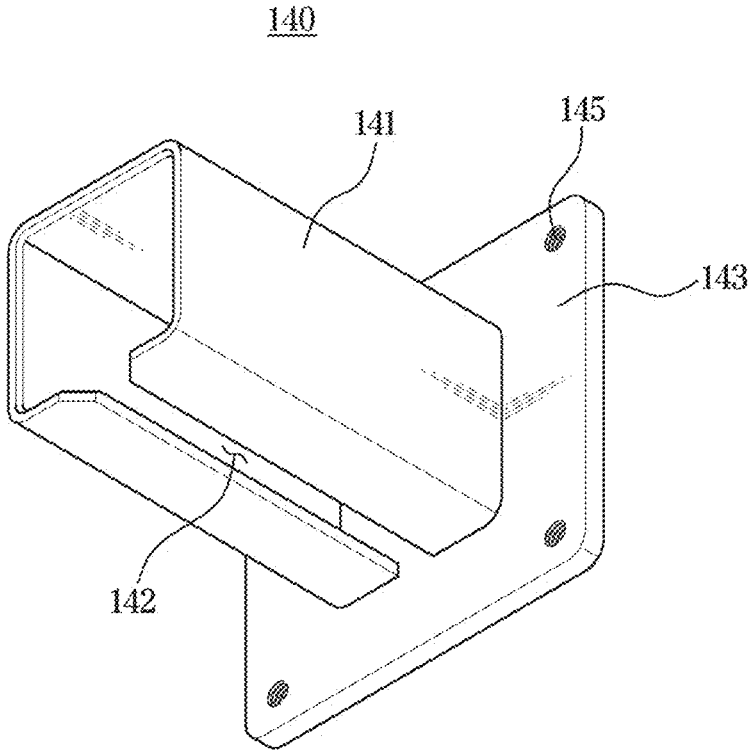
FIG. 6 is a perspective view illustrating the second bracket of FIG. 5 when viewed from a different direction according to various embodiments.

FIG. 3 is a perspective view illustrating a bracket according to various embodiments. FIG. 4 is a perspective view illustrating a state in which a support screw is fastened to a first bracket according to various embodiments. FIG. 5 is a perspective view illustrating a second bracket according to various embodiments. FIG. 6 is a perspective view illustrating the second bracket of FIG. 5 when viewed from a different direction according to various embodiments.

As shown in FIGS. 3, 4, 5 and 6 (which may be referred to as FIG. 3 to FIG. 6), the bracket 120 mounted in the mounting groove 3 formed on the wall 1 may include a first bracket 130 mounted directly in the mounting groove 3. The bracket 120 may include a second bracket 140 fixed to the first bracket 130. The bracket 120 may include a support screw 150 fastened to the first bracket 130 to support a load of the first bracket 130. (See FIG. 2)

The first bracket 130 may include a mounting plate 131 mounted into the mounting groove 3 formed on the wall 1. The mounting plate 131 may have a rectangular shape. The mounting plate 131 may include a plurality of mounting holes 132 to be mounted in the mounting groove 3 using screws S. The plurality of mounting holes 132 may be formed at corners of the mounting plate 131. The plurality of mounting holes 132 may be formed at each corner of the mounting plate 131. Although the mounting plate 131 is shown as a rectangular shape, the mounting plate 131 is not limited thereto. That is, the mounting plate 131 may have various shapes as long as it may be mounted in the mounting groove 3. In addition, although the four mounting holes 132 at each corner of the mounting plate 131 are shown, the disclosure is not limited thereto. For example, the plurality of mounting holes 132 may be formed in portions other than the corners of the mounting plate 131. Accordingly, the plurality of mounting holes 132 may be formed in three or fewer, or five or more instead of four. (See FIG. 2)

The first bracket 130 may include a protrusion 133 provided to protrude to an outside of the mounting groove 3 on the mounting plate 131. The protrusion 133 may extend forward from the front of the mounting plate 131. The protrusion 133 may have a rectangular column shape. Because the protrusion 133 is in a rectangular column shape, when the wall mount 20 is fixed to the wall mount fixture 100 after the display 10 is mounted on the wall mount 20, the display 10 may be prevented or inhibited from rotating even though an external force is applied to the display 10. (See FIG. 1 and FIG. 2)

The protrusion 133 may include a fastening hole 134 into which the support screw 150 is fastened. The fastening hole 134 may be formed to penetrate the protrusion 133 in a vertical direction. The support screw 150 may be fastened to the fastening hole 134 in a lower portion of the protrusion 133. The support screw 150 may support the load of the first bracket 130 in the lower portion of the protrusion 133. For example, the support screw 150 may support the protrusion 133 in the lower portion of the protrusion 133 to support the load of the first bracket 130.

The protrusion 133 may include a fixing groove 135 in which a fixing plate 143 is fixed to a front of the protrusion 133 by a screw S. The fixing groove 135 may be formed in a center of the front of the protrusion 133. A single fixing groove 135 may be formed in the center of the front of the protrusion 133. Because the fixing plate 143 of the second bracket 140 is fixed to the protrusion 133 of the first bracket 130 by a single screw S, the second bracket 140 and the first bracket 130 may be easily fixed to each other. (See FIG. 11)

The second bracket 140 may be fit into (inserted into) and fixed to the first bracket 130. The second bracket 140 may be fit into the first bracket 130 from the front of the first bracket 130 and be fixed thereto.

The second bracket 140 may include a receiving portion 141 in which the protrusion 133 of the first bracket 130 is accommodated. When the second bracket 140 is fit into the first bracket 130, the protrusion 133 of the first bracket 130 may be received in the receiving portion 141 of the second bracket 140. For example, the second bracket 140 may be fit into the first bracket 130 to allow the protrusion 133 of the first bracket 130 to be received in the receiving portion 141 of the second bracket 140. The receiving portion 141 may extend rearward from a rear of the fixing plate 143. The receiving portion 141 may have a rectangular column shape to correspond to the shape of the protrusion 133.

The receiving portion 141 may include a cut portion 142 cut to allow the support screw 150 fastened to the protrusion 133 to pass, when the receiving portion 141 is fit into the protrusion 133. The cut portion 142 may be cut in a forward and backward direction in a lower portion of the receiving portion 141. When the second bracket 140 is inserted into the first bracket 130, the receiving portion 141 may be fit into the protrusion 133. In this instance, because the support screw 150 is fastened to the lower portion of the protrusion 133, the cut portion 142 may be formed in the receiving portion 141 where the protrusion 133 is received in order to allow the support screw 150 to pass.

The second bracket 140 may include the fixing plate 143 fixed to the protrusion 133. The fixing plate 143 may be provided at a front of the receiving portion 141. The fixing plate 143 may have a rectangular shape. The extension bracket 110 may be fixed to the fixing plate 143. (See FIG. 2)

The fixing plate 143 may include a fixing hole 144 fixed to the fixing groove 135 of the protrusion 133 by a screw S. The fixing hole 144 may be formed in a center of the fixing plate 143. Like the fixing groove 135, a single fixing hole 144 may be formed. Because the fixing plate 143 of the second bracket 140 is fixed to the protrusion 133 of the first bracket 130 by a single screw S, the second bracket 140 may be easily fixed to the first bracket 130. (See FIG. 11)

The fixing plate 143 may include a plurality of extension bracket fixing holes 145 to which the extension bracket 110 is fixed. The plurality of extension bracket fixing holes 145 may be formed at corners of the fixing plate 143. The plurality of extension bracket fixing holes 145 may be formed at each corner of the fixing plate 143. Although the fixing plate 143 is shown as a rectangular shape, the fixing plate 143 is not limited thereto. For example, the fixing plate 143 may have various shapes as long as the extension bracket 110 may be fixed. In addition, it is shown that the plurality of extension bracket fixing holes 145 are formed at four corners of the fixing plate 143, but the disclosure is not limited thereto. For example, the plurality of extension bracket fixing holes 145 may be formed in portions other than the corners of the fixing plate 143. Accordingly, the number of extension bracket fixing holes 145 may be three or fewer, or five or more, instead of four. (See FIG. 2)

The support screw 150 may be fastened to the protrusion 133 of the first bracket 130. The support screw 150 may be fastened to the fastening hole 134 formed in the protrusion 133. The support screw 150 may be fastened to the lower portion of the protrusion 133 through the fastening hole 134. The support screw 150 may support the first bracket 130 inside the mounting groove 3. The support screw 150 may be supported by a bottom surface of the mounting groove 3 inside the mounting groove 3. The support screw 150 may support the first bracket 130 and may distribute a load of the display 10 applied to the first bracket 130 and the screws S that mount the mounting plate 131 in the mounting groove 3, thereby ensuring stability. That is, the load of the display 10 applied to the screws S that mount the first bracket 130 in the mounting groove 3 may be distributed by the support screw 150, thereby ensuring stability. (See FIG. 2)

A process of mounting the bracket 120 in the mounting groove 3 formed on the wall 1 is described in greater detail below with reference to FIG. 7 to FIG. 12.

Figure 7:
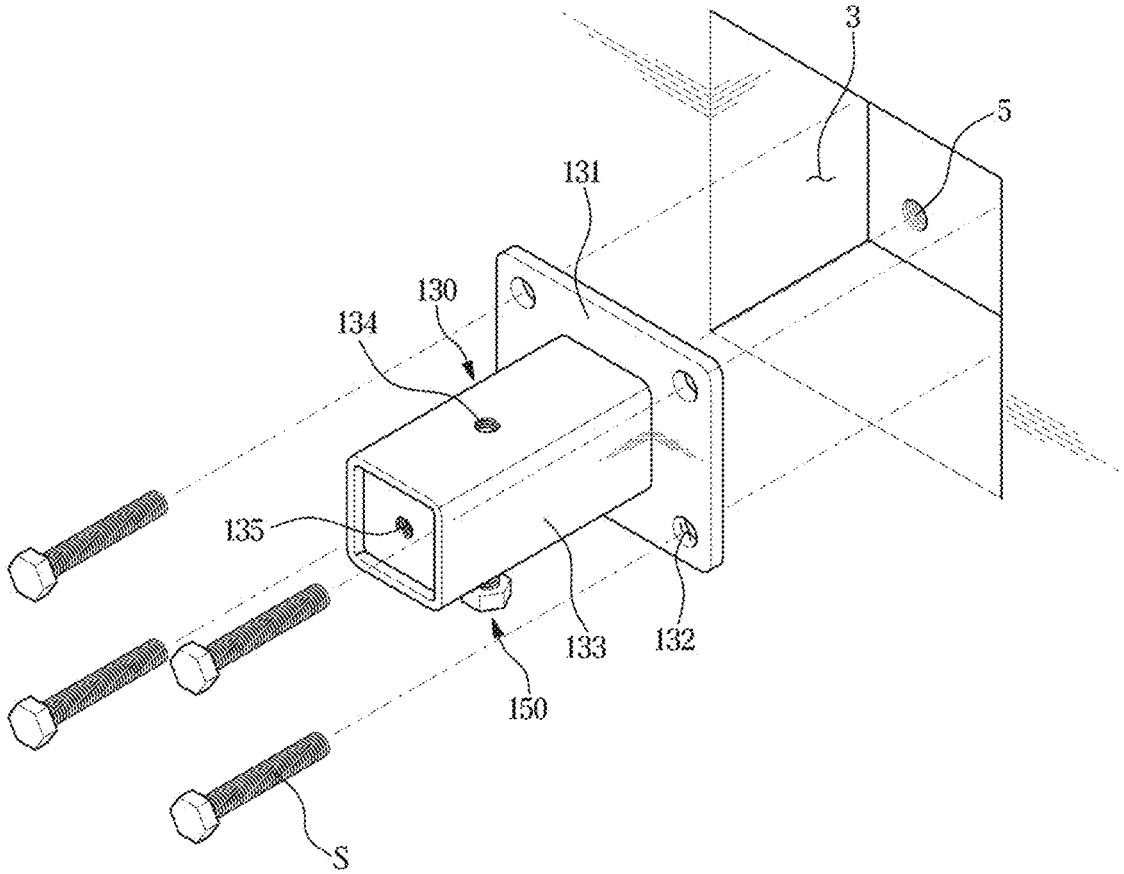
FIG. 7 is an exploded perspective view illustrating a first bracket mounted in a mounting groove by screws according to various embodiments.
Figure 8:
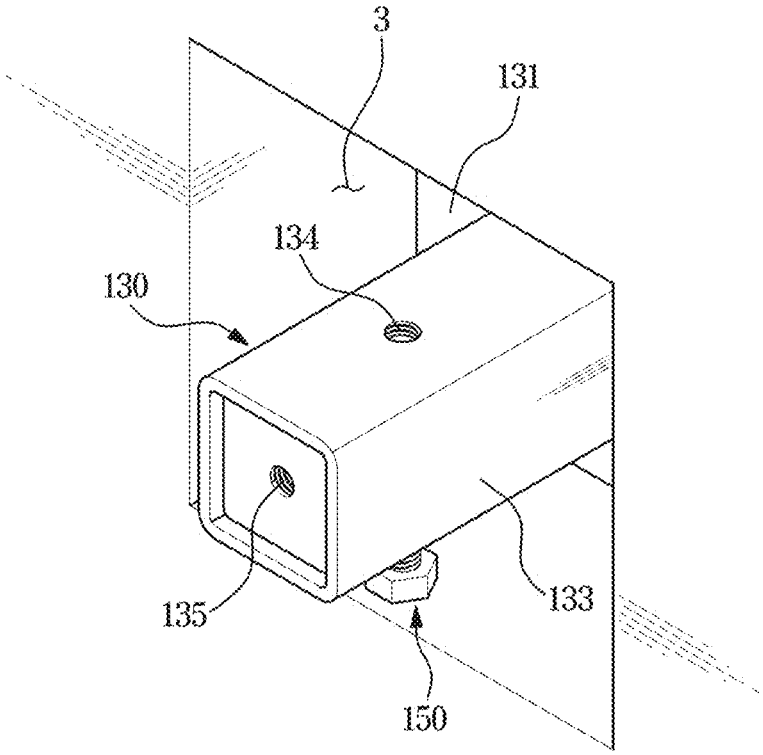
FIG. 8 is a perspective view illustrating a state in which a first bracket is mounted in a mounting groove according to various embodiments.
Figure 9:
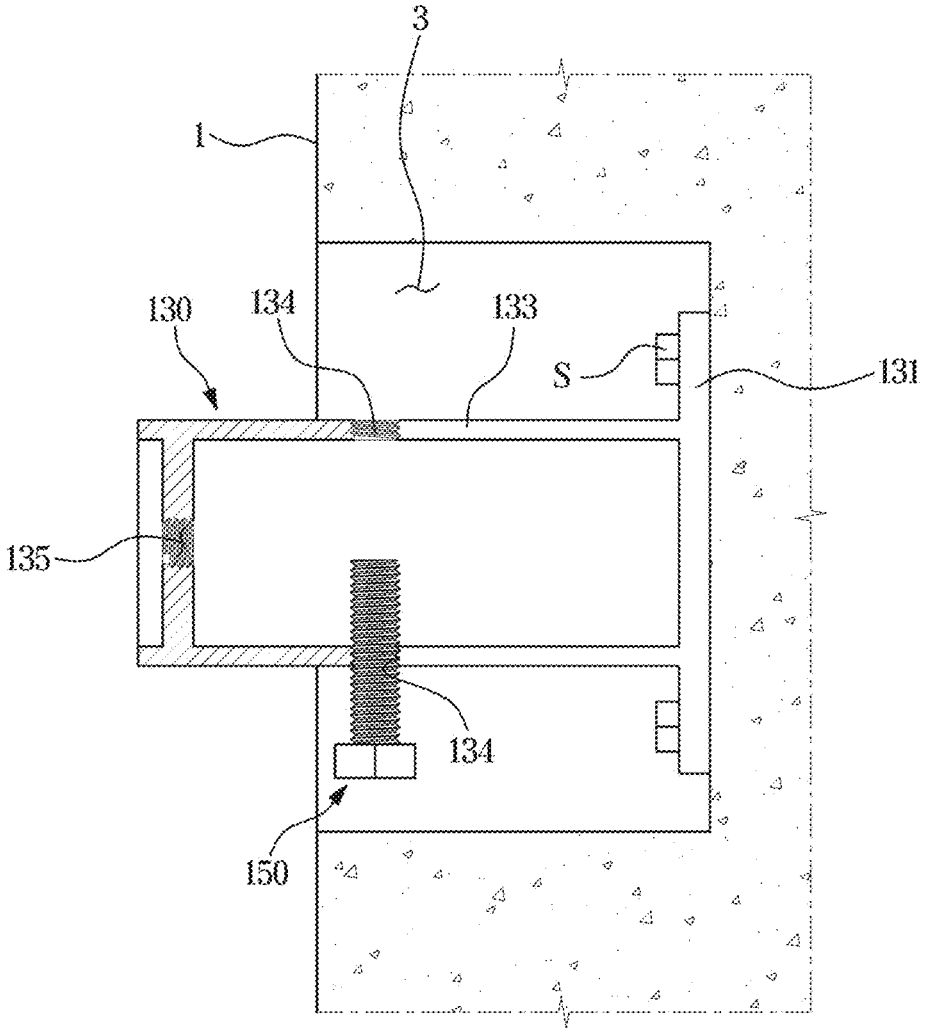
FIG. 9 is a cross-sectional view illustrating a state in which a first bracket is mounted in a mounting groove according to various embodiments.
Figure 10:
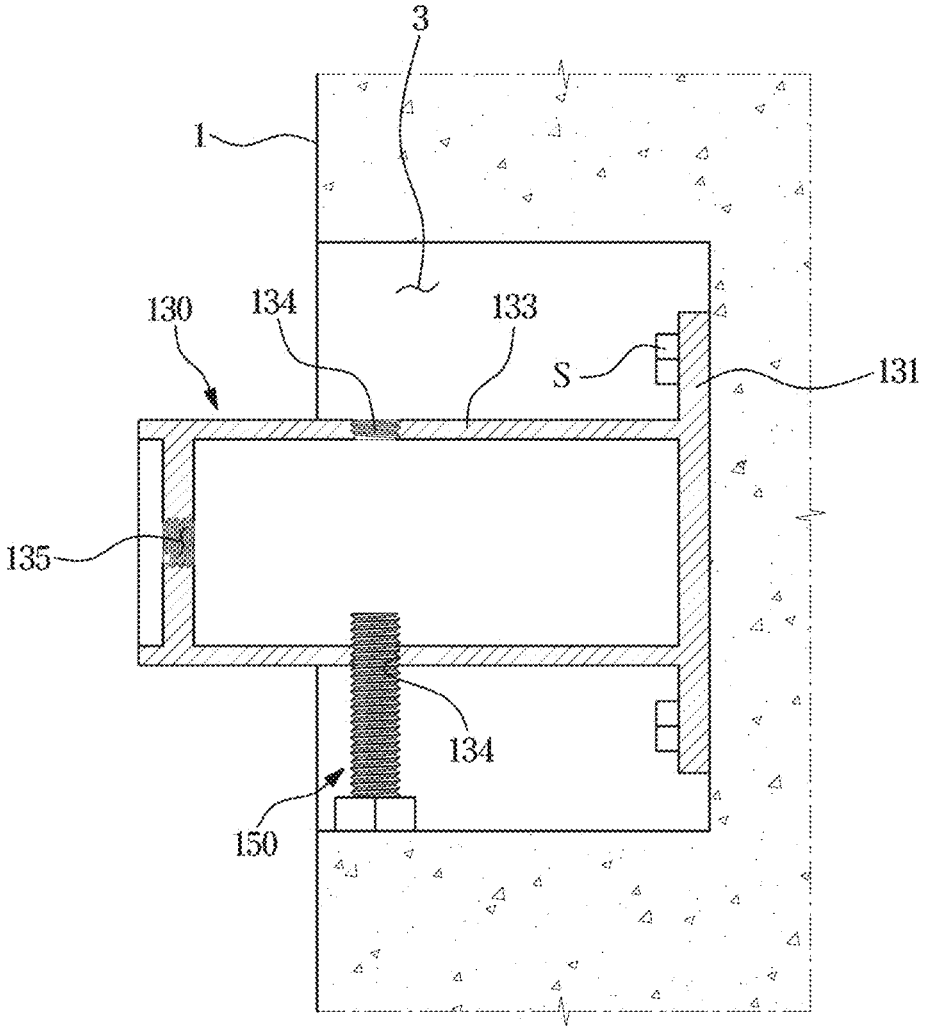
FIG. 10 is a cross-sectional view illustrating a state in which a support screw is supported by a bottom surface of the mounting groove by rotating the support screw in FIG. 9 according to various embodiments.
Figure 11:
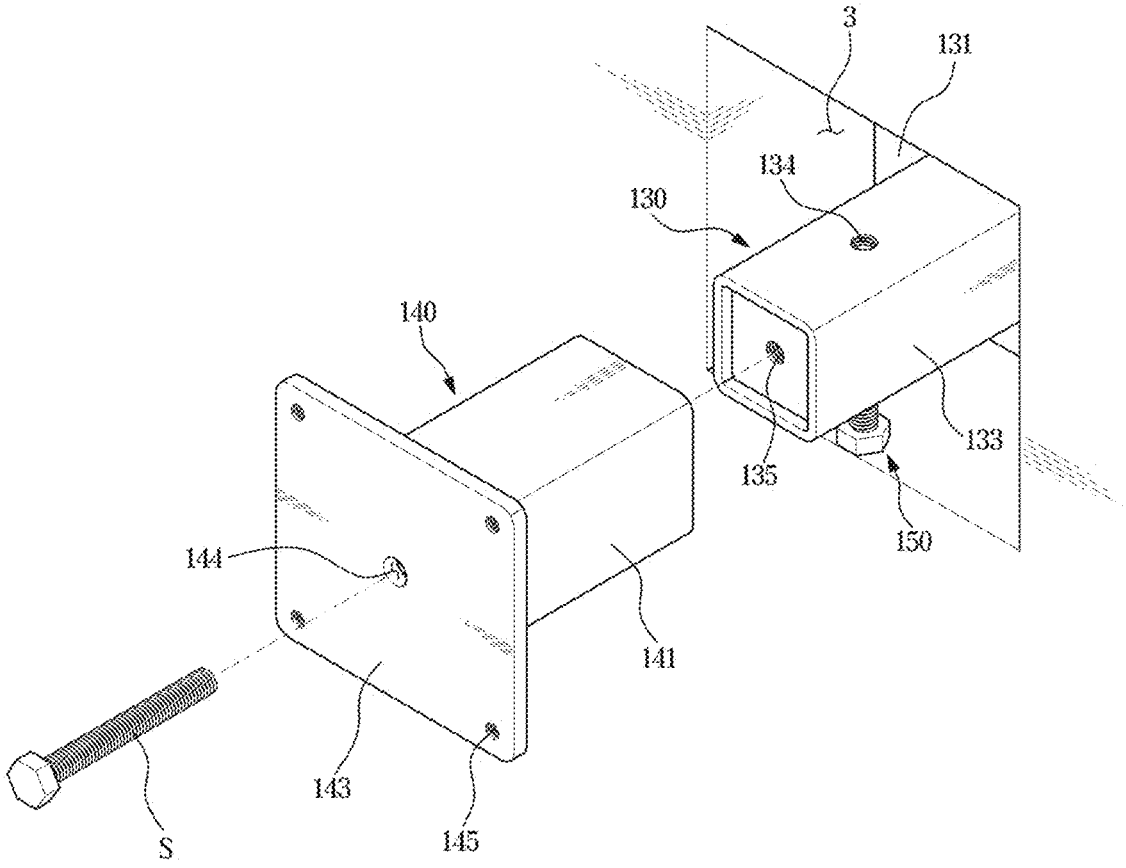
FIG. 11 is an exploded perspective view illustrating a second bracket fixed to a first bracket by a screw according to various embodiments.
Figure 12:
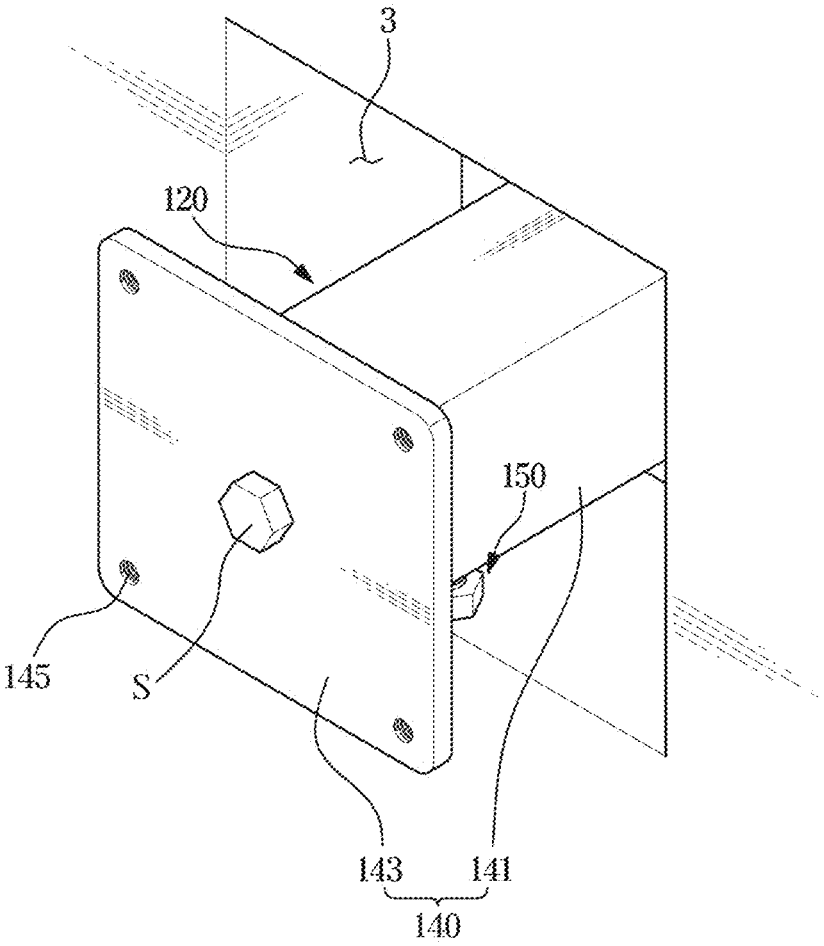
FIG. 12 is a perspective view illustrating a state in which a second bracket is fixed to a first bracket and mounted in a mounting groove according to various embodiments.

FIG. 7 is an exploded perspective view illustrating a first bracket mounted in a mounting groove by screws according to various embodiments. FIG. 8 is a perspective view illustrating a state in which a first bracket is mounted in a mounting groove according to various embodiments. FIG. 9 is a cross-sectional view illustrating a state in which a first bracket is mounted in a mounting groove according to various embodiments. FIG. 10 is a cross-sectional view illustrating a state in which a support screw is supported by a bottom surface of the mounting groove by rotating the support screw in FIG. 9 according to various embodiments. FIG. 11 is an exploded perspective view illustrating a second bracket fixed to a first bracket by a screw according to various embodiments. FIG. 12 is a perspective view illustrating a state in which a second bracket is fixed to a first bracket and mounted in a mounting groove according to various embodiments.

As shown in FIG. 7, the first bracket 130 may be mounted in the mounting groove 3 using screws S. The screws S may penetrate the plurality of mounting holes 132 formed in the mounting plate 131 of the first bracket 130, and may be mounted into a plurality of bracket mounting holes 5 formed on a rear wall inside the mounting groove 3. Accordingly, the first bracket 130 may be mounted in the mounting groove 3 by the screws S.

As shown in FIG. 8 and FIG. 9, when the first bracket 130 is mounted in the mounting groove 3 by the screws S, a lower portion of the support screw 150 fastened to the fastening hole 134 of the protrusion 133 may be spaced apart from a bottom surface of the mounting groove 3.

In a state where the lower portion of the support screw 150 is spaced apart from the bottom surface of the mounting groove 3, by rotating the support screw 150 in a direction to release the support screw 150 from the fastening hole 134, the support screw 150 may be released from the fastening hole 134 and the lower portion of the support screw 150 may be supported by the bottom surface of the mounting groove 3, as shown in FIG. 10. By supporting the support screw 150 on the bottom surface of the mounting groove 3, a load of the display 10 may be distributed when the display 10 is mounted on the wall mount 20 fixed to the wall mount fixture 100, and thus the display 10 may be stably supported. (See FIG. 2)

When the support screw 150 is supported on the bottom surface of the mounting groove 3, the second bracket 140 may be fixed to the first bracket 130 by the screw S as shown in FIG. 11. The second bracket 140 may be inserted into the first bracket 130 to allow the protrusion 133 of the first bracket 130 to be received in the receiving portion 141. After the second bracket 140 is fit into the first bracket 130, the second bracket 140 may be fixed to the first bracket 130 by the screw S. That is, the screw S may penetrate the fixing hole 144 of the second bracket 140 and may be fixed to the fixing groove 135 of the first bracket 130. Accordingly, the second bracket 140 may be fixed to the first bracket 130 by the screw S. Because the second bracket 140 is fixed to the first bracket 130 by the single screw S, the second bracket 140 may be easily fixed to the first bracket 130.

As shown in FIG. 12, when the second bracket 140 is fixed to the first bracket 130 by the screw S, the extension bracket 110 may be fixed to the extension bracket fixing hole 145 of the second bracket 140. (See FIG. 2)

Figure 13:
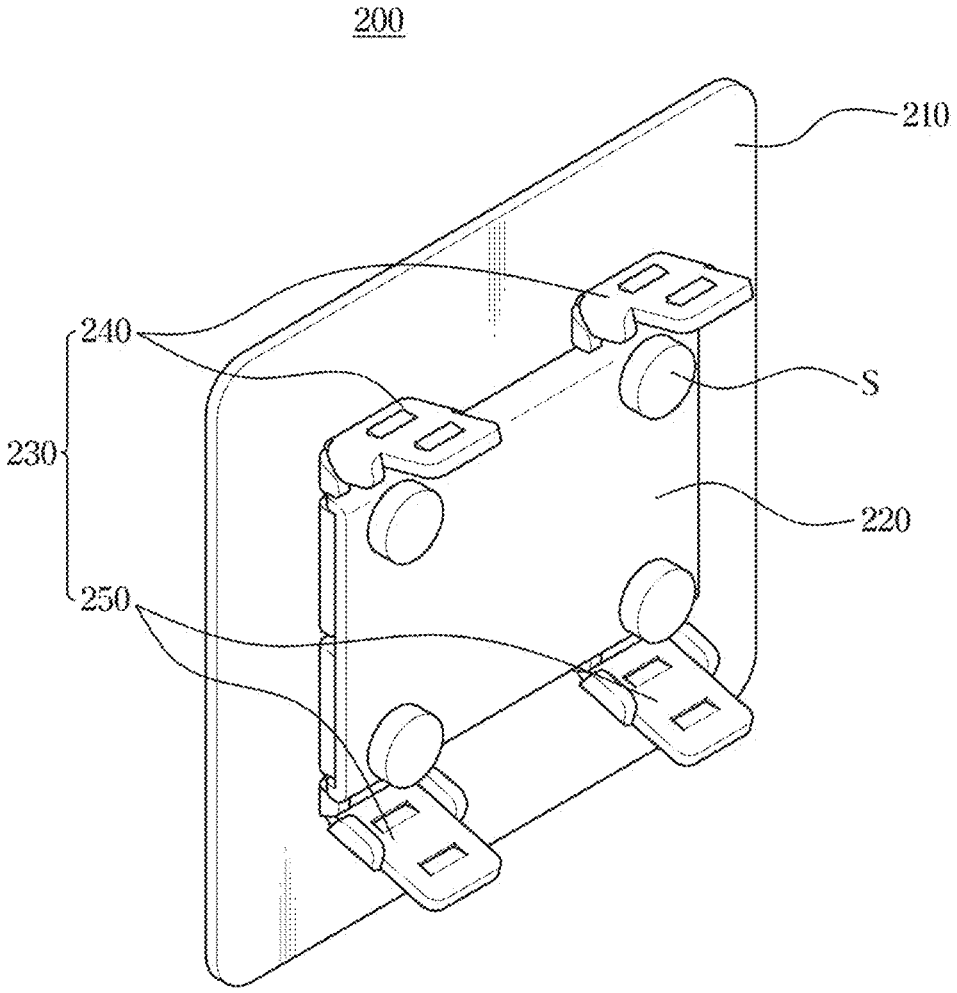
FIG. 13 is a perspective view illustrating a wall mount fixture according to various embodiments.

FIG. 13 is a perspective view illustrating a wall mount fixture according to various embodiments.

As shown in FIG. 13, a wall mount fixture 200 may include a first plate 210 and a second plate 220 coupled by a plurality of screws S. The wall mount fixture 200 may include four brackets 230 disposed between the first plate 210 and the second plate 220. The four brackets 230 may include a pair of first brackets 240 disposed on upper left and upper right sides of the second plate 220, and a pair of second brackets 250 disposed on lower left and lower right sides of the second plate 220.

Figure 14:
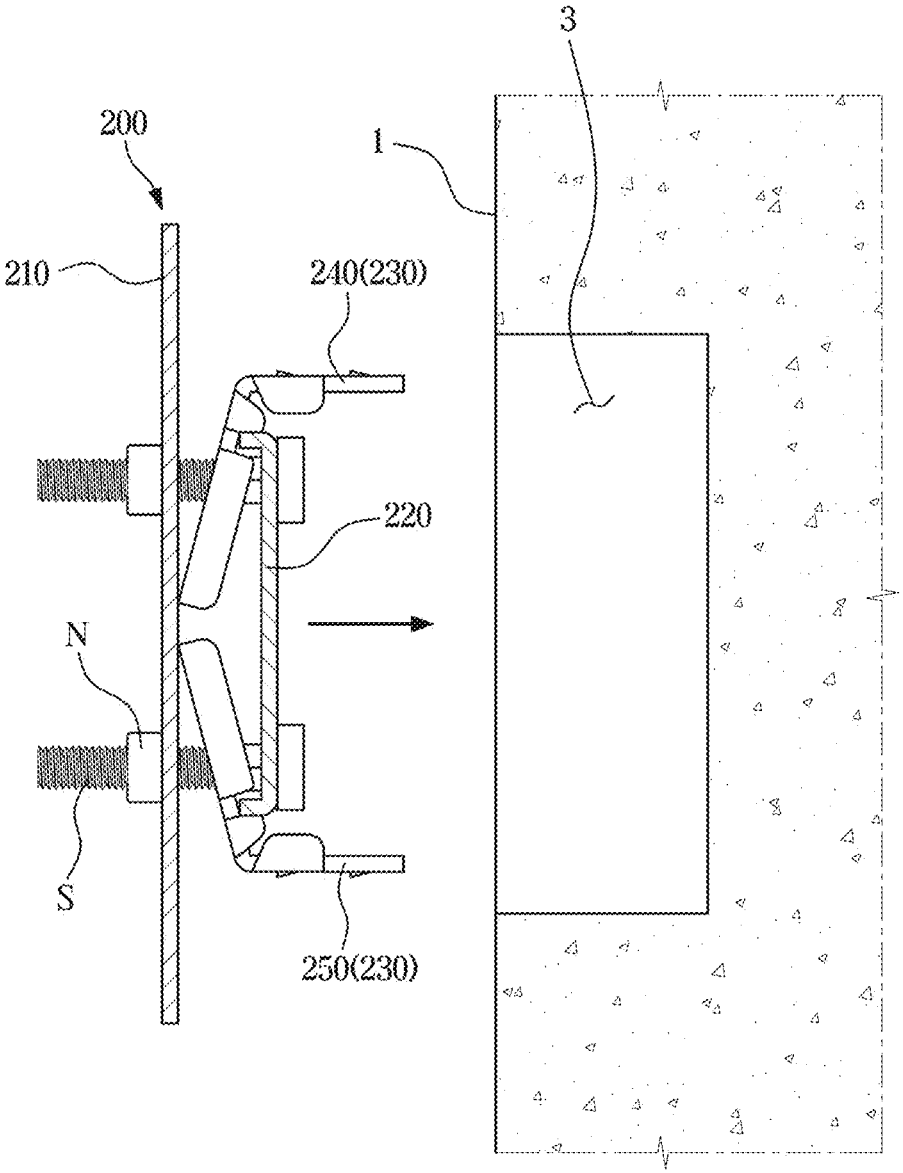
FIG. 14 is a cross-sectional view illustrating a second plate and four brackets of a wall mount fixture inserted into a mounting groove formed on a wall according to various embodiments.
Figure 15:
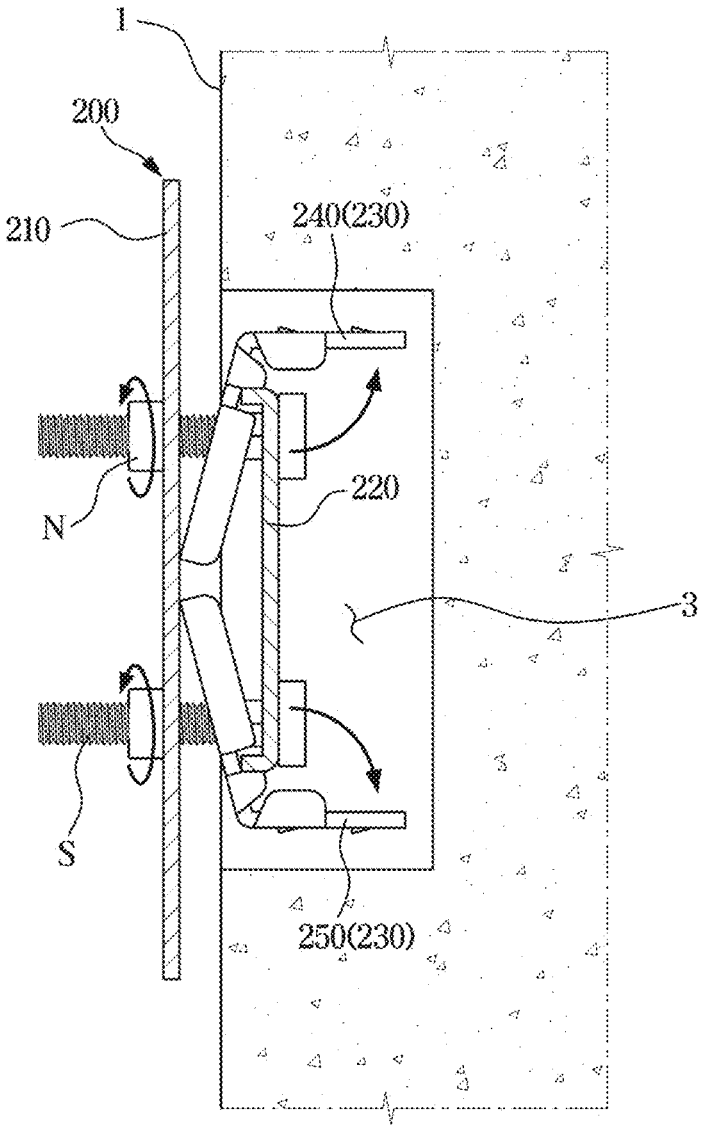
FIG. 15 is a cross-sectional view illustrating a nut rotated in a state where a second plate and four brackets of a wall mount fixture are inserted into a mounting groove formed on a wall according to various embodiments.
Figure 16:
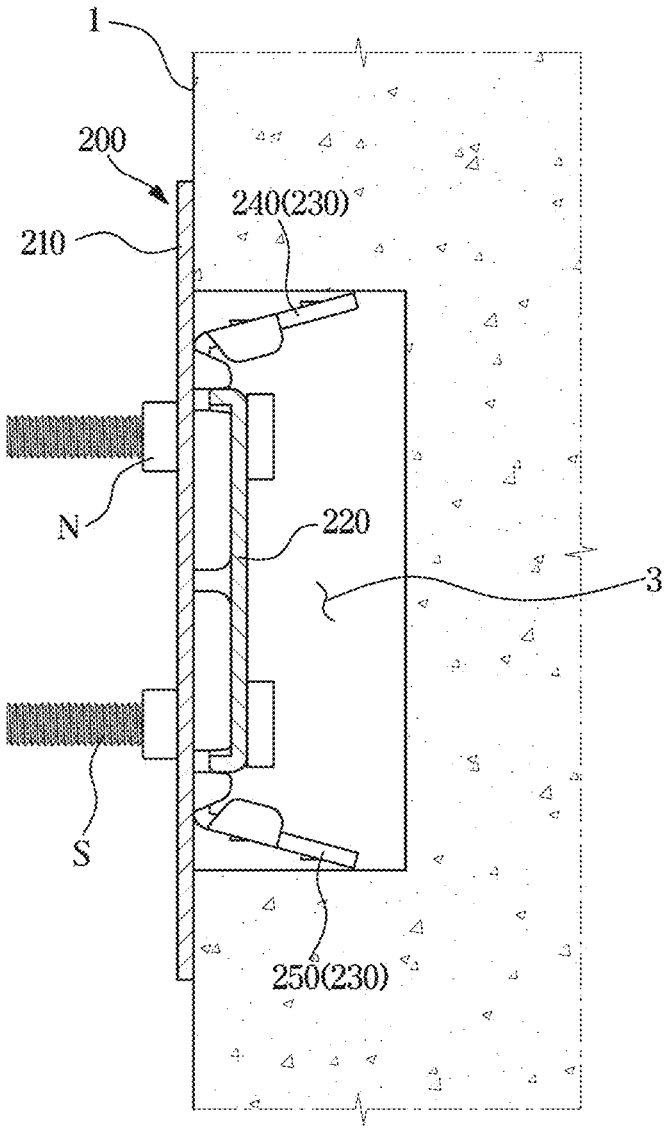
FIG. 16 is a cross-sectional view illustrating a state in which a first plate is in close contact with a wall by rotating a screw and the four brackets are fixed in the mounting groove in FIG. 15 according to various embodiments.

FIG. 14 is a cross-sectional view illustrating the second plate and four brackets of the wall mount fixture inserted into a mounting groove formed on a wall according to various embodiments. FIG. 15 is a cross-sectional view illustrating a nut rotated in a state where the second plate and four brackets of the wall mount fixture are inserted into the mounting groove formed on a wall according to various embodiments. FIG. 16 is a cross-sectional view illustrating a state in which the first plate is in close contact with a wall by rotating a screw and the four brackets are fixed in the mounting groove in FIG. 15 according to various embodiments.

As shown in FIG. 14, the wall mount fixture 200 may be inserted into the mounting groove 3 formed on the wall 1 after the first plate 210 and the second plate 220 are spaced apart as much as possible. In order to space the first plate 210 apart from the second plate 220 as much as possible, a nut N may be rotated in a direction to loosen the nut N from the screw S. By spacing the first plate 210 apart from the second plate 220 as much as possible, the four brackets 230 disposed between the first plate 210 and the second plate 220 may be rotated. Among the four brackets 230, the pair of first brackets 240 disposed in an upper portion in the drawing may be rotated clockwise. Among the four brackets 230, the pair of second brackets 250 disposed in a lower portion in the drawing may be rotated counterclockwise. The pair of first brackets 240 and the pair of second brackets 250 may each be rotated to be inserted into the mounting groove 3.

As shown in FIG. 15, the nut N may be rotated in a state where the second plate 220 and the four brackets 230 are inserted into the mounting groove 3. In this instance, the nut N may be rotated in the direction to lock the screw S. By rotating the nut N, a gap between the first plate 210 and the second plate 220 may be narrowed, and the first plate 210 may be moved toward the wall 1 to come closer to the wall 1. When the gap between the first plate 210 and the second plate 220 is narrowed, the pair of first brackets 240 may be rotated counterclockwise. In addition, the pair of second brackets 250 may be rotated clockwise.

As shown in FIG. 16, when the pair of first brackets 240 are rotated counterclockwise and the pair of second brackets 250 are rotated clockwise as the first plate 210 comes into close contact with the wall 1, the pair of first brackets 240 may be in contact with an upper surface inside the mounting groove 3, and the pair of second brackets 250 may be in contact with a bottom surface inside the mounting groove 3. Accordingly, the wall mount fixture 200 may be fixed in the mounting groove 3. When the wall mount fixture 200 is fixed in the mounting groove 3, the wall mount 20 may be fixed to the screws S protruding out of the mounting groove 3. The wall mount 20 may be directly fixed to the screws S, or the extension bracket 110 may be fixed to the screws S and then the wall mount 20 may be fixed to the extension bracket 110. (See FIG. 2)

Figure 17:
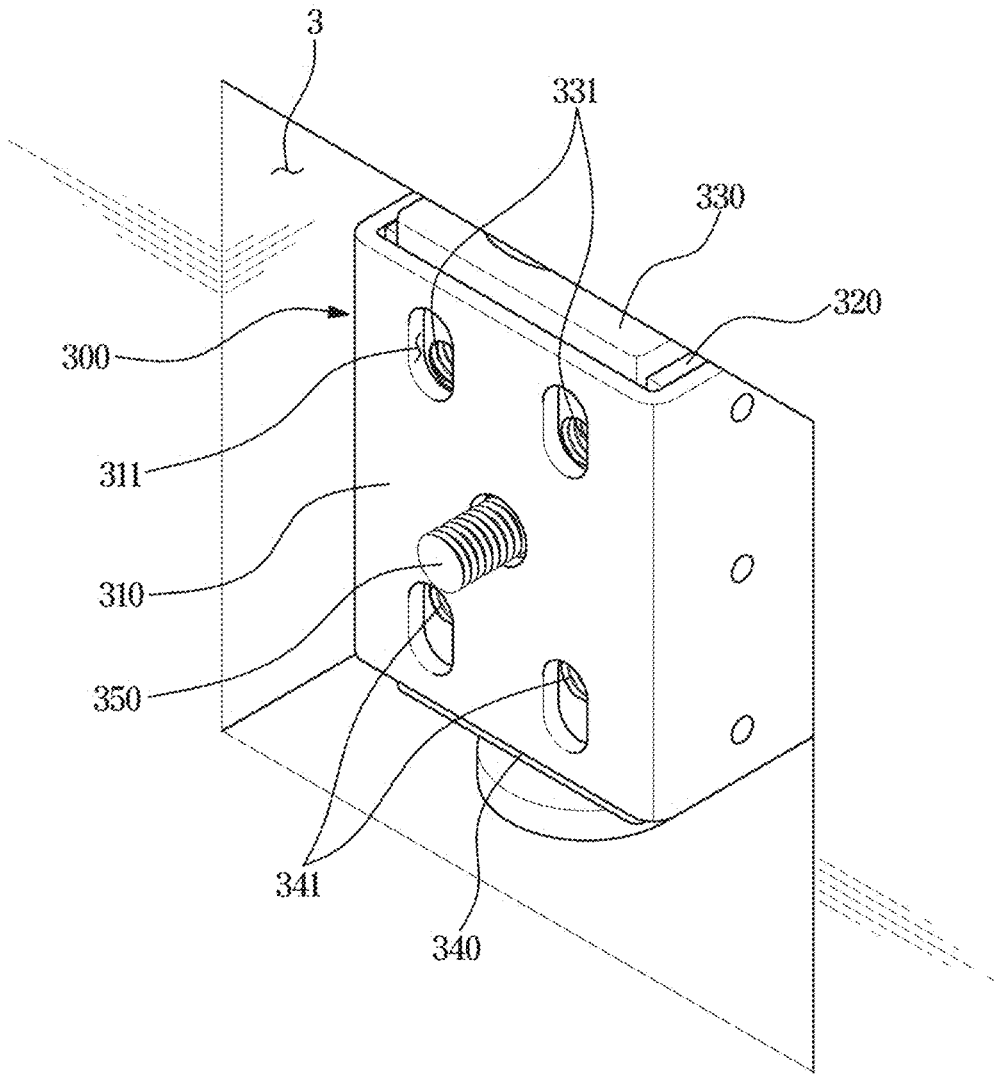
FIG. 17 is a perspective view illustrating a state in which a wall mount fixture is inserted into a mounting groove according to various embodiments.
Figure 18:
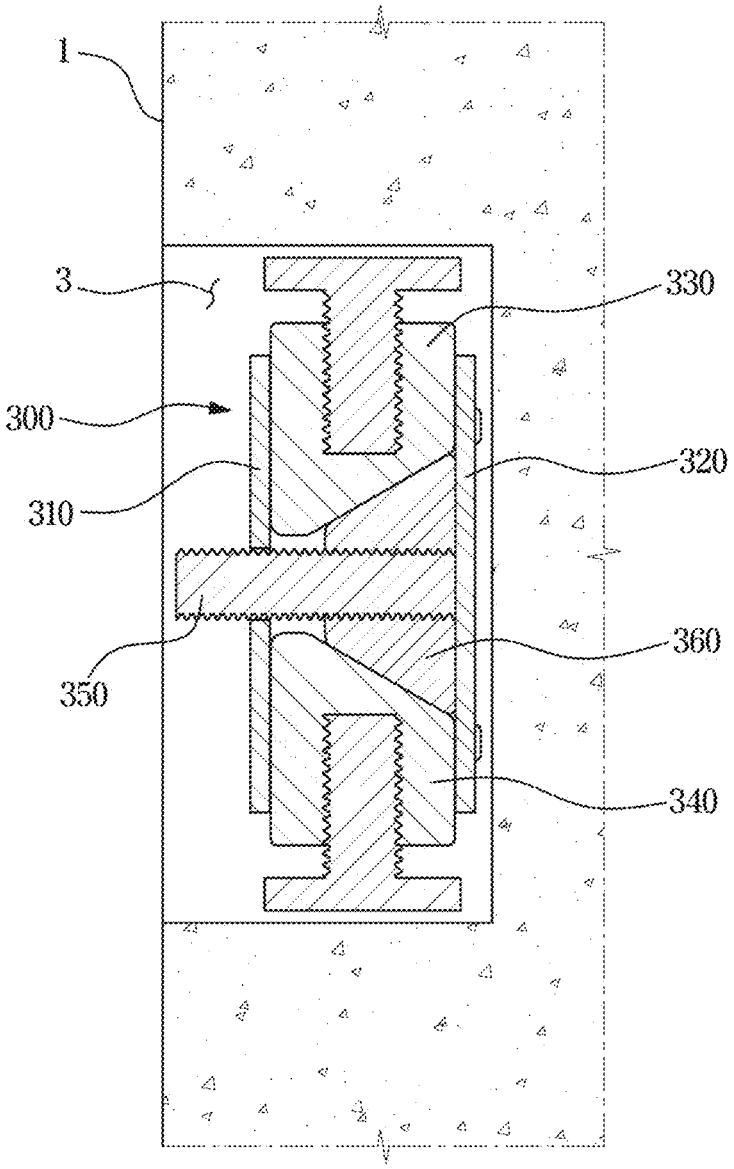
FIG. 18 is a cross-sectional view illustrating a state in which a wall mount fixture is inserted into a mounting groove according to various embodiments.
Figure 19:
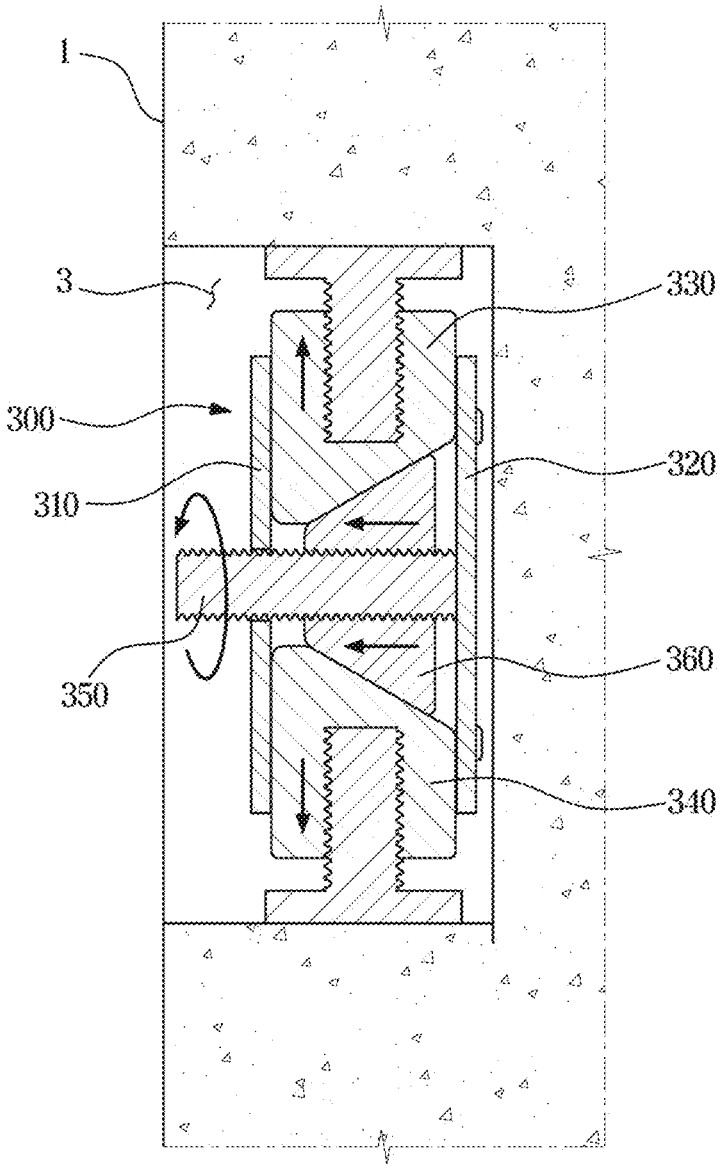
FIG. 19 is a cross-sectional view illustrating a state in which the wall mount fixture is fixed in the mounting groove by rotating a fixing screw in FIG. 18 according to various embodiments.
Figure 20:
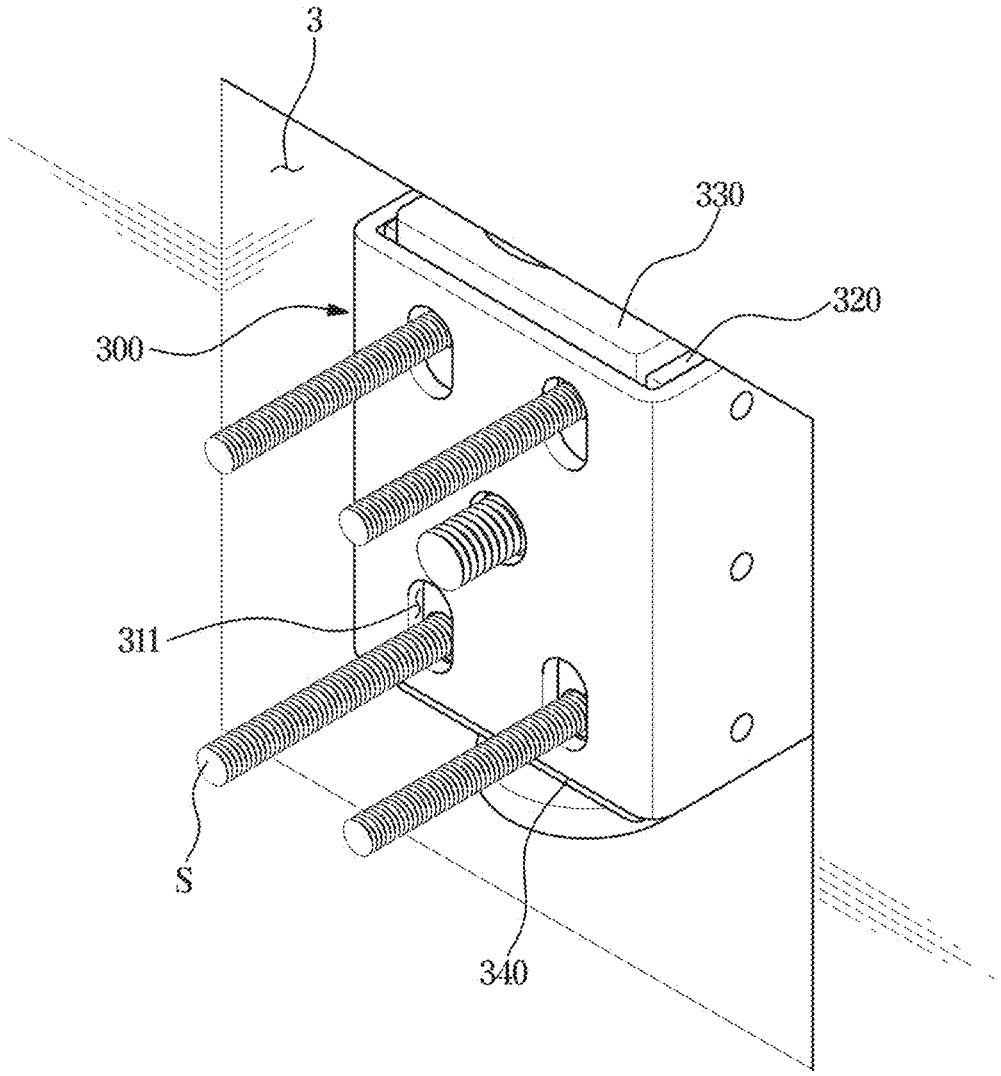
FIG. 20 is a perspective view illustrating a state in which screws are mounted on screw mounting holes provided in a first bracket in a state where a wall mount fixture is fixed in a mounting groove according to various embodiments.

FIG. 17 is a perspective view illustrating a state in which a wall mount fixture is inserted into a mounting groove according to various embodiments. FIG. 18 is a cross-sectional view illustrating a state in which the wall mount fixture is inserted into the mounting groove according to various embodiments. FIG. 19 is a cross-sectional view illustrating a state in which the wall mount fixture is fixed in the mounting groove by rotating a fixing screw in FIG. 18 according to various embodiments. FIG. 20 is a perspective view illustrating a state in which screws are mounted on screw mounting holes provided in a first bracket in a state where a wall mount fixture is fixed in the mounting groove according to various embodiments.

As shown in FIG. 17 and FIG. 18, a wall mount fixture 300 may include a first bracket 310 and a second bracket 320 fastened to a rear of the first bracket 310. The wall mount fixture 300 may include a pair of fixing brackets 330 and 340 provided between the first bracket 310 and the second bracket 320. The wall mount fixture 300 may include a fixing screw 350 fastened to the first bracket 310. The wall mount fixture 300 may include a moving portion 360 provided between the first bracket 310 and the second bracket 320 to be connected to the fixing screw 350.

The first bracket 310 may be provided with a plurality of through holes 311 through which a plurality of screws S penetrate. The number of the plurality of screws S may be provided to correspond to the number of the plurality of through holes 311. Accordingly, each of the screws S may penetrate each of the through holes 311. The plurality of screws S may penetrate the plurality of through holes 311, and may be mounted in a plurality of screw mounting holes 331 and 341 provided in a pair of fixing brackets 330 and 340. The through holes 311 may be formed to be longer in a vertical direction than the plurality of screw mounting holes 331 and 341. Because the through holes 311 are formed to be longer in the vertical direction than the plurality of screw mounting holes 331 and 341, even when the pair of fixing brackets 330 and 340 move in the vertical direction, the plurality of screws S may pass through the through holes 311 and may be mounted in the plurality of screw mounting holes 331 and 341.

The pair of fixing brackets 330 and 340 provided between the first bracket 310 and the second bracket 320 may include the upper fixing bracket 330 provided in upper portions of the first bracket 310 and the second bracket 320. The pair of fixing brackets 330 and 340 provided between the first bracket 310 and the second bracket 320 may include a lower fixing bracket 340 provided in lower portions of the first bracket 310 and the second bracket 320. The upper fixing bracket 330 and the lower fixing bracket 340 may be movable in a vertical direction in the drawing.

The fixing screw 350 may be fastened to a central portion of the first bracket 310. The fixing screw 350 may be connected to the moving portion 360. By rotating the screw 350 connected to the moving portion 360, the moving portion 360 may be moved forward and backward.

The moving portion 360 may be provided between the first bracket 310 and the second bracket 320. The moving portion 360 may be movable in the forward and backward direction between the first bracket 310 and the second bracket 320. The moving portion 360 may contact the pair of fixing brackets 330 and 340 between the first bracket 310 and the second bracket 320. The moving portion 360 may move in the forward and backward direction to move the pair of fixing brackets 330 and 340 in the vertical direction.

As shown in FIG. 19, by rotating the fixing screw 350 in a direction of an arrow in a state where the wall mount fixture 300 is inserted into the mounting groove 3, the moving portion 360 connected to the fixing screw 350 may move forward. When the moving portion 360 moves forward, the upper fixing bracket 330 of the pair of fixing brackets 330 and 340 in contact with the moving portion 360 may be moved upward. In this instance, the lower fixing bracket 340 may be moved downward. When the upper fixing bracket 330 and the lower fixing bracket 340 are moved in the upper and lower directions, respectively, the upper fixing bracket 330 comes into contact with an upper surface of the mounting groove 3, and the lower fixing bracket 340 comes into contact with a bottom surface of the mounting groove 3. When the fixing screw 350 is further rotated in a state where the upper fixing bracket 330 and the lower fixing bracket 340 are in contact with the upper surface and bottom surface of the mounting groove 3, respectively, the wall mount fixture 300 may be fixed in the mounting groove 3.

As shown in FIG. 20, when the wall mount fixture 300 is fixed in the mounting groove 3, a plurality of screws S may be mounted in the screw mounting holes 331 of the upper fixing bracket 330 and in the screw mounting holes 341 of the lower fixing bracket 340 by passing through the through holes 311 provided in the first bracket 310. By mounting the plurality of screws S in the screw mounting holes 331 and 341, the wall mount 20 may be fixed to the plurality of screws S protruding out of the mounting groove 3. The wall mount 20 may be directly fixed to the plurality of screws S, or the extension bracket 110 may be fixed to the plurality of screws S and then the wall mount 20 may be fixed to the extension bracket 110. (See FIG. 2).

Figure 21:
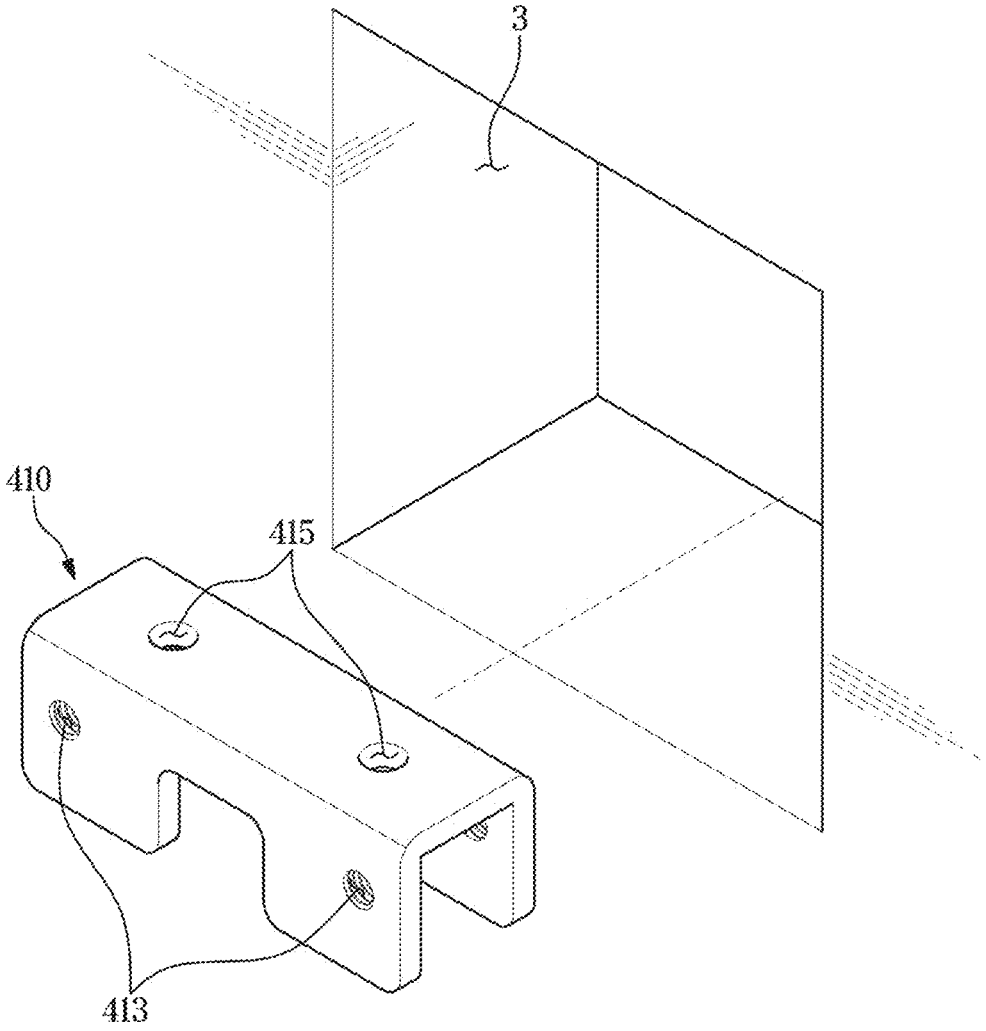
FIG. 21 is a perspective view illustrating a lower fixing bracket of a wall mount fixture inserted into a mounting groove according to various embodiments.
Figure 22:
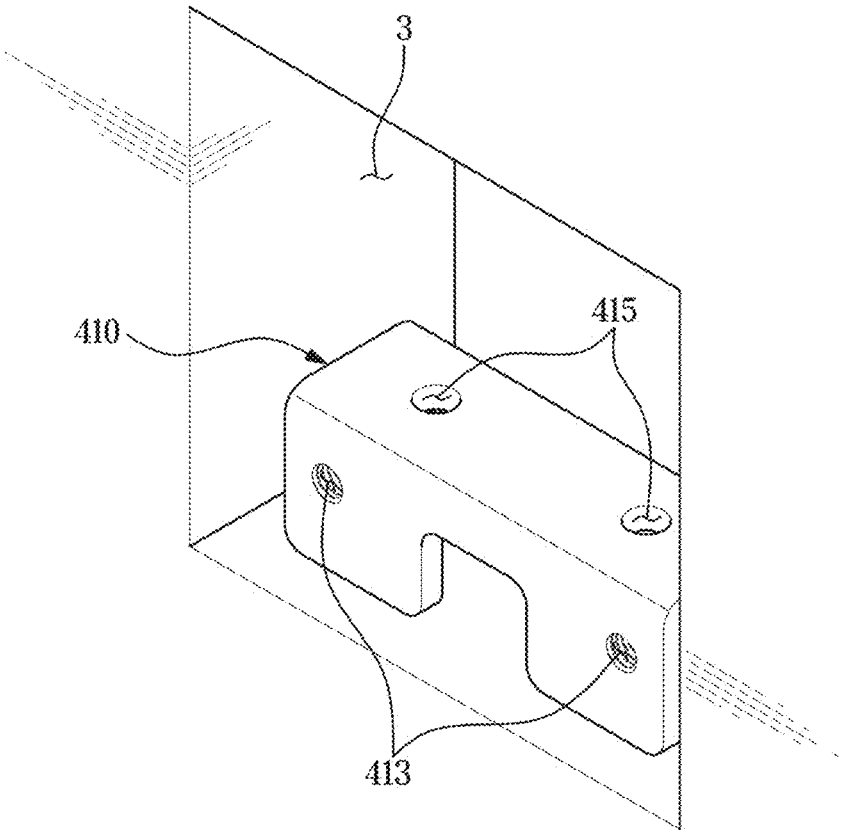
FIG. 22 is a perspective view illustrating a state in which a lower fixing bracket of a wall mount fixture is inserted into a mounting groove according to various embodiments.
Figure 23:
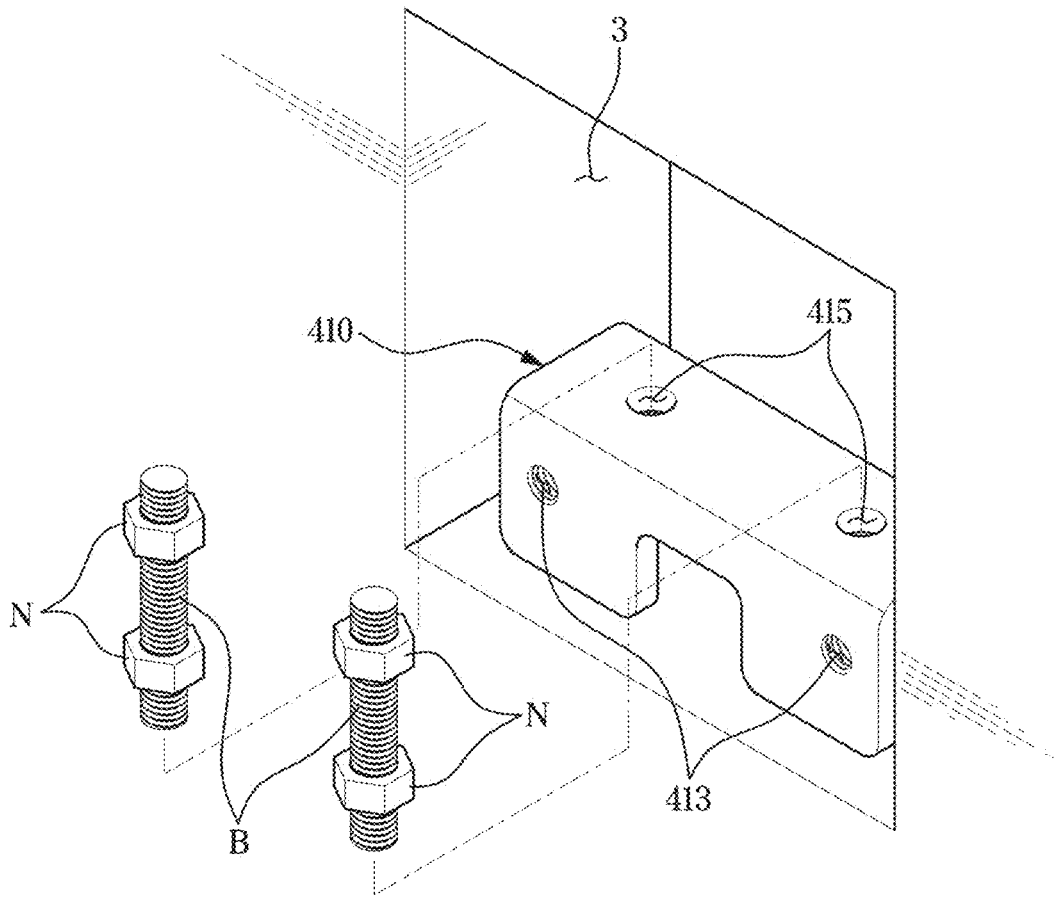
FIG. 23 is a perspective view illustrating bolts coupled to a lower fixing bracket of a wall mount fixture inserted into a mounting groove according to various embodiments.
Figure 24:
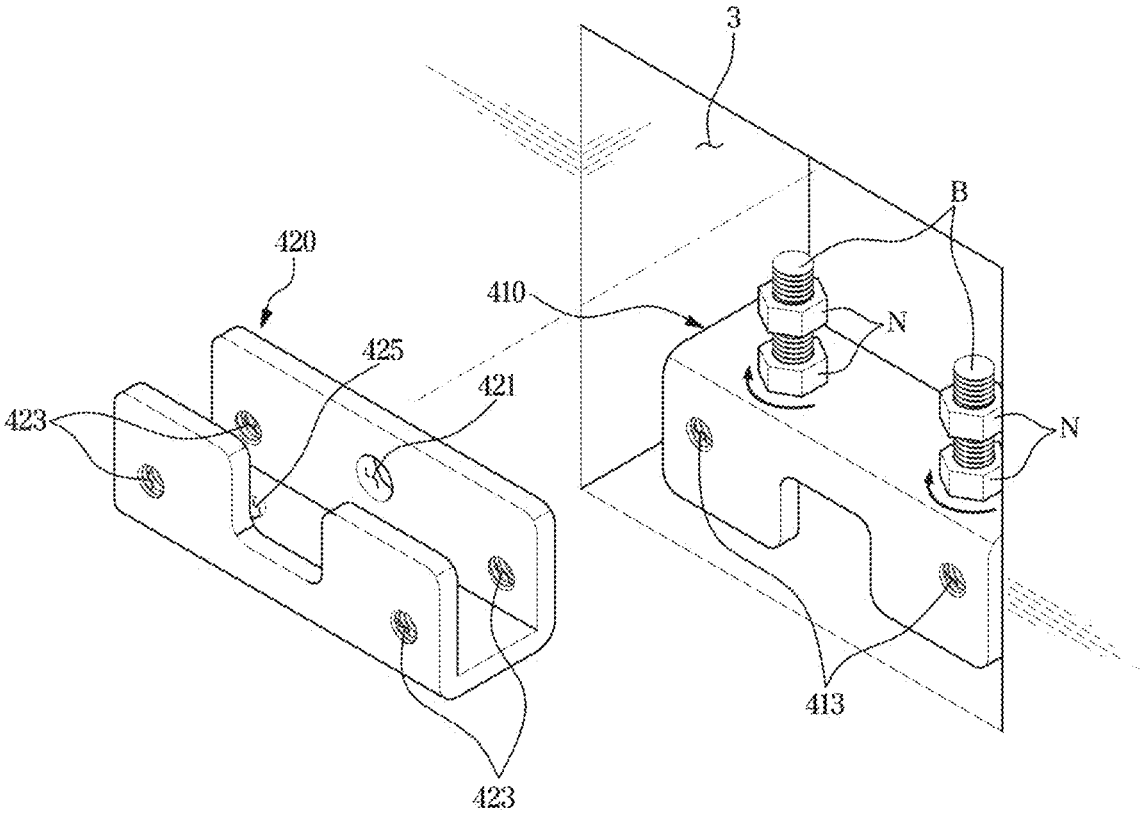
FIG. 24 is a perspective view illustrating a lower fixing bracket of a wall mount fixture inserted into a mounting groove fixed by nuts and an upper fixing bracket inserted into the mounting groove according to various embodiments.

FIG. 21 is a perspective view illustrating a lower fixing bracket of a wall mount fixture inserted into a mounting groove according to various embodiments. FIG. 22 is a perspective view illustrating a state in which the lower fixing bracket of the wall mount fixture is inserted into the mounting groove according to various embodiments. FIG. 23 is a perspective view illustrating bolts coupled to the lower fixing bracket of the wall mount fixture inserted into the mounting groove according to various embodiments. FIG. 24 is a perspective view illustrating the lower fixing bracket of the wall mount fixture inserted into the mounting groove fixed by nuts and an upper fixing bracket inserted into the mounting groove according to various embodiments. FIG.

Figure 26:
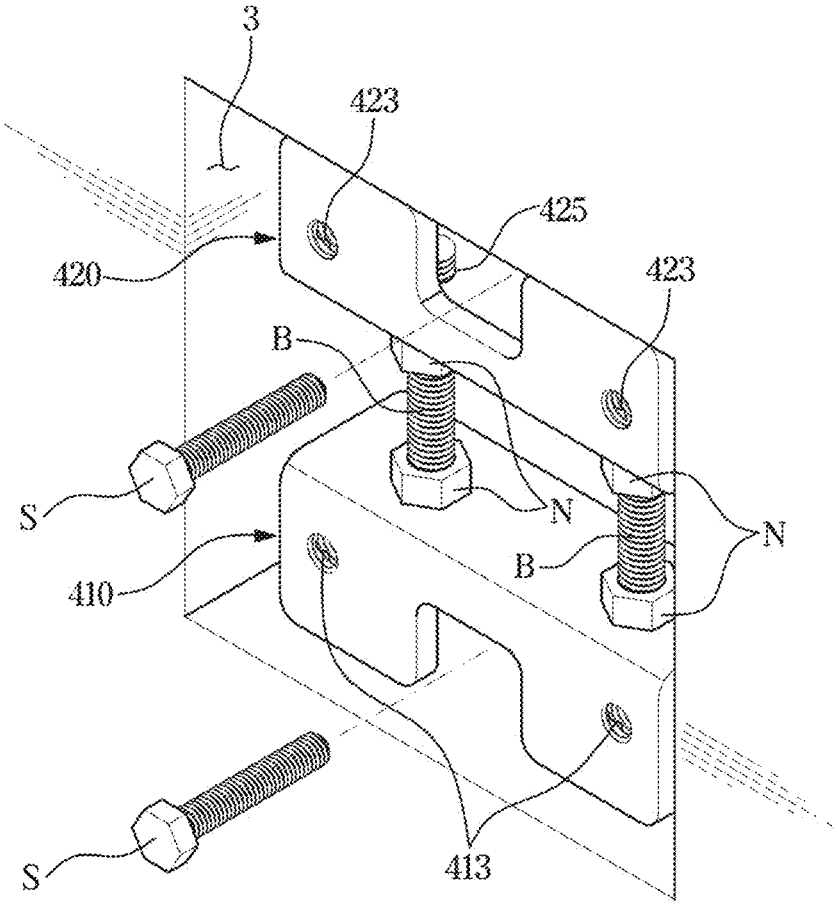
FIG. 26 is a perspective view illustrating a fixing bracket of a wall mount fixture fixed in a mounting groove and mounted on the mounting groove by screws according to various embodiments.
Figure 27:
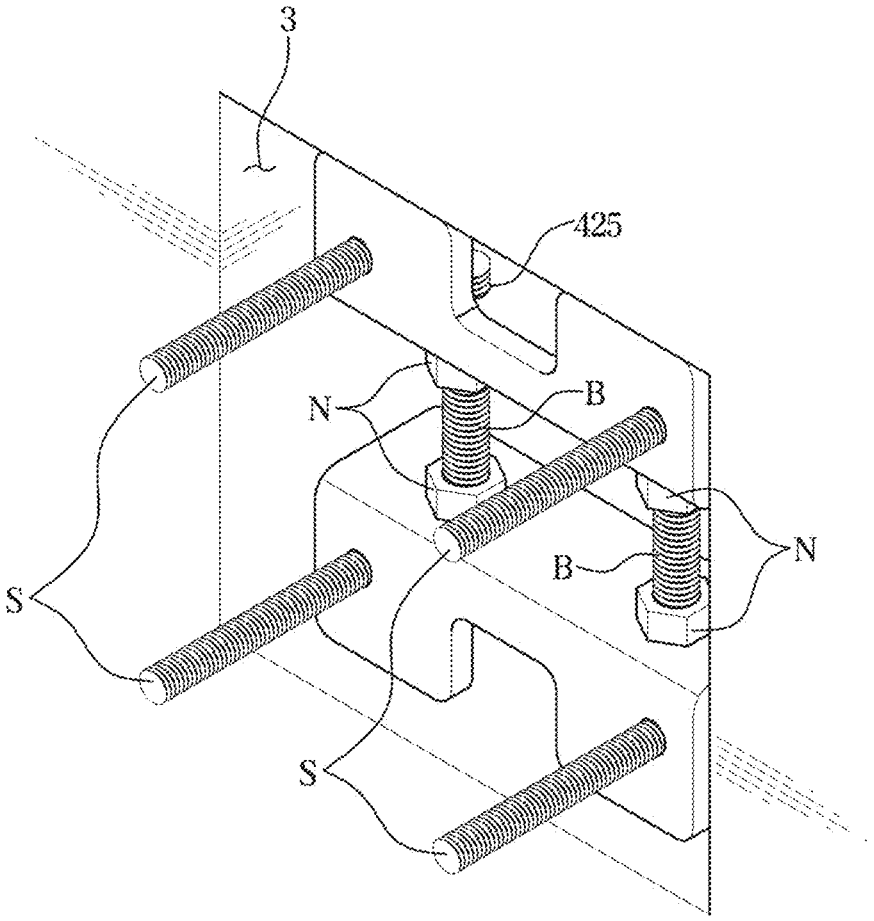
FIG. 27 is a perspective view illustrating a state in which a fixing bracket of a wall mount fixture is fixed in a mounting groove and is connected to a plurality of screws according to various embodiments.

25 is a perspective view illustrating the upper fixing bracket of the wall mount fixture inserted into the mounting groove fixed by nuts according to various embodiments. FIG. 26 is a perspective view illustrating the fixing bracket of the wall mount fixture fixed in the mounting groove and mounted on the mounting groove by screws according to various embodiments. FIG. 27 is a perspective view illustrating a state in which the fixing bracket of the wall mount fixture is fixed in the mounting groove and is connected to a plurality of screws according to various embodiments.

As shown in FIG. 21 and FIG. 22, a wall mount fixture 400 may include a lower fixing bracket 410. In order to mount the lower fixing bracket 410 in the mounting groove 3, the lower fixing bracket 410 may be inserted into the mounting groove 3.

As shown in FIG. 23, the wall mount fixture 400 may include bolts B and nuts N for fixing the lower fixing bracket 410 in the mounting groove 3. The bolt B to which the nut Nis fastened may be fastened to a bolt fastening hole 415 of the lower fixing bracket 410. Two nuts N may be fastened to the bolt B.

As shown in FIG. 24, the wall mount fixture 400 may include an upper fixing bracket 420. When the bolt B to which the nut N is fastened to the bolt fastening hole 415 of the lower fixing bracket 410, the nut N disposed at a lower portion of the two nuts N fastened to the bolt B may be rotated in a direction of an arrow to fix the lower fixing bracket 410 to a bottom surface of the mounting groove 3. When the lower fixing bracket 410 is fixed to the bottom surface of the mounting groove 3, the upper fixing bracket 420 may be inserted into the mounting groove 3.

Figure 25:
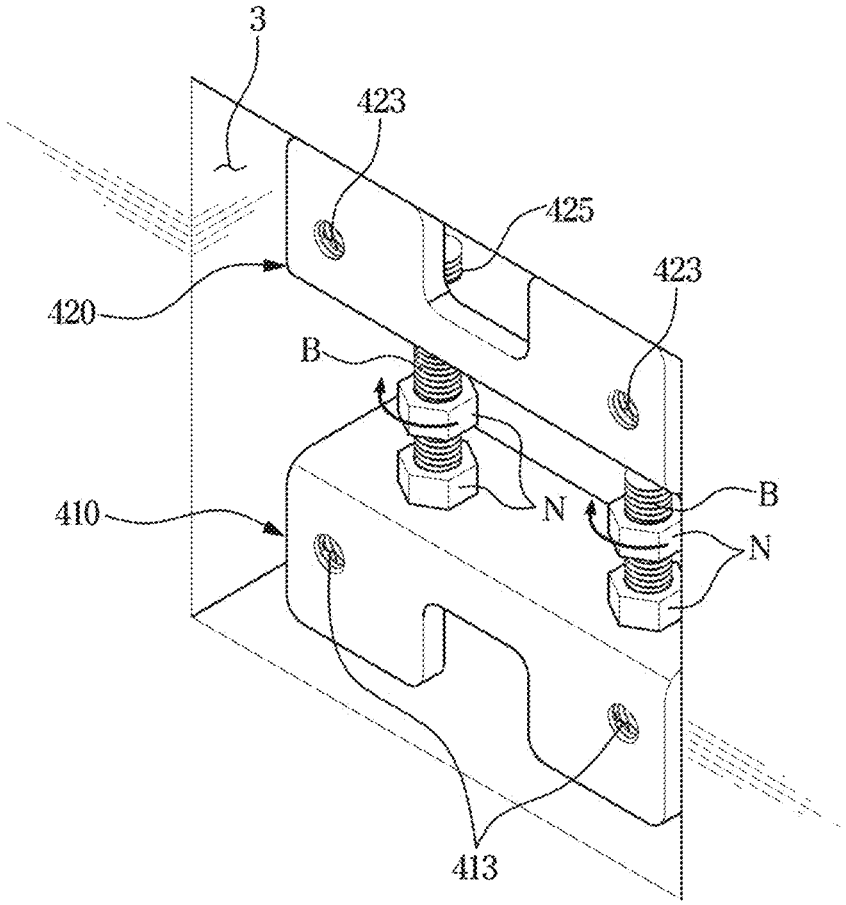
FIG. 25 is a perspective view illustrating an upper fixing bracket of a wall mount fixture inserted into a mounting groove fixed by nuts according to various embodiments.

As shown in FIG. 25, when the upper fixing bracket 420 is inserted into the mounting groove 3, the bolt B to which the nut N is fastened may be fastened to a bolt fastening hole 425 (see FIG. 24) of the upper fixing bracket 420. By fastening the bolt B to which the nut N is fastened to the bolt fastening hole 425 (see FIG. 24) of the upper fixing bracket 420, the nut Nin an upper portion of the two nuts N fastened to the bolt B may be rotated in a direction of an arrow to fix the upper fixing bracket 420 to an upper surface of the mounting groove 3.

As shown in FIG. 26, when the fixing brackets 410 and 420 including the lower fixing bracket 410 and the upper fixing bracket 420 are fixed in the mounting groove 3, the fixing brackets 410 and 420 may be mounted in the mounting groove 3 by the screws S mounted in a screw mounting hole (not shown) of the lower fixing bracket 410 and a screw mounting hole 421 (see FIG. 24) of the upper fixing bracket 420.

As shown in FIG. 27, when the fixing brackets 410 and 420 are mounted in the mounting groove 3, a plurality of screws S may be connected to a plurality of screw connection holes 413 and 423 formed in the fixing brackets 410 and 420. When the plurality of screws S are connected to the screw connection holes 413 and 423, the wall mount 20 may be fixed to the plurality of screws S protruding out of the mounting groove 3. The wall mount 20 may be directly fixed to the plurality of screws S, or the extension bracket 110 may be fixed to the plurality of screws S and then the wall mount 20 may be fixed to the extension bracket 110. (See FIG. 2, FIG. 24 and FIG. 25)

According to an example embodiment of the disclosure, a display apparatus may include: a display; a wall mount on which the display is configured to be mounted; and a wall mount fixture to which the wall mount is configured to be fixed. The wall mount fixture may include: an extension bracket to which the wall mount is configured to be fixed; a first bracket including a mounting plate configured to be mounted into a mounting groove provided on a wall and a protrusion protruding to an outside of the mounting groove on the mounting plate; a second bracket including a receiving portion configured to receive the protrusion and a fixing plate provided in front of the receiving portion to be fixed to the protrusion and to fix the extension bracket; and a support screw configured to be fastened to a lower portion of the protrusion and to support the protrusion inside the mounting groove. According to the disclosure, when the display 10 is mounted on the wall mount 20, the support screw 150 of the wall mount fixture 100 to which the wall mount is fixed may distribute a load of the display 10, thereby ensuring stability.

A length of the support screw 150 to be fastened to the protrusion 133 may be adjusted to allow the first bracket 130 to be supported by a bottom surface of the mounting groove in a state where the first bracket is mounted in the mounting groove. According to the disclosure, when the display 10 is mounted on the wall mount 20, the support screw 150 of the wall mount fixture 100 to which the wall mount is fixed may distribute a load of the display 10, thereby ensuring stability.

The mounting plate 131 may have a rectangular shape, and may include a plurality of mounting holes 132 configured to be mounted in the mounting groove 3 by a screw S.

The plurality of mounting holes 132 may be formed at corners of the mounting plate 131.

The protrusion 133 may have a rectangular column shape. According to the disclosure, when the display 10 is mounted on the wall mount 20, the display may be prevented or inhibited from rotating by an external force.

The protrusion 133 may include: a fastening hole 134 configured to penetrate the protrusion in a vertical direction, and to be fastened to the support screw 150; and a fixing groove 135 in which the fixing plate 143 is fixed to a front of the protrusion by a screw S. According to the disclosure, when the display 10 is mounted on the wall mount 20, the support screw 150 of the wall mount fixture 100 to which the wall mount is fixed may distribute a load of the display 10, thereby ensuring stability. The second bracket 140 may be fixed to the first bracket 130 mounted in the mounting groove 3 by a single screw S, thereby easily fixing the second bracket to the first bracket.

The fixing groove 135 may be provided in a center of the front of the protrusion 133.

The fixing plate 143 may have a rectangular shape, and may include a fixing hole 144 configured to fix the fixing plate to the fixing groove 135 by the screw S.

The fixing groove 135 and the fixing hole 144 may each be provided as a single. According to the disclosure, the second bracket 140 may be fixed to the first bracket 130 mounted inside the mounting groove 3 by a single screw S, thereby easily fixing the second bracket to the first bracket.

The fixing plate 143 may include a plurality of extension bracket fixing holes 145 configured to fix the extension bracket 110.

The plurality of extension bracket fixing holes 145 may be formed at corners of the fixing plate 143.

The receiving portion 141 may include a cut portion 142 configured to allow the support screw 150 to pass when the receiving portion is fit into the protrusion 133. According to the disclosure, the second bracket 140 may be easily fit into the first bracket 130 mounted in the mounting groove 3.

The receiving portion 141 may have a rectangular column shape, and the cut portion 142 may be cut in a lower portion of the receiving portion in a forward and backward direction. According to the disclosure, when the display 10 is mounted on the wall mount 20, the display may be prevented or inhibited from rotating by an external force.

According to an embodiment of the disclosure, a display apparatus may include: a display 10; a wall mount 20 on which the display is mounted; and a wall mount fixture 100 to which the wall mount is fixed. The wall mount fixture may include: an extension bracket 110 to which the wall mount is fixed; a first bracket 130 including a mounting plate 131 mounted into a mounting groove 3 formed on a wall 1 and a protrusion 133 protruding to an outside of the mounting groove on the mounting plate; a second bracket 140 including a receiving portion 141 configured to receive the protrusion and a fixing plate 143 provided in front of the receiving portion to fix the extension bracket; and a support screw 150 configured to support the protrusion inside the mounting groove, wherein the fixing plate may be fixed to the protrusion by a single screw S. According to the disclosure, when the display 10 is mounted on the wall mount 20, the support screw 150 of the wall mount fixture 100 to which the wall mount is fixed may distribute a load of the display 10, thereby ensuring stability. The second bracket 140 may be fixed to the first bracket 130 mounted in the mounting groove 3 by a single screw S, thereby easily fixing the second bracket to the first bracket.

The protrusion 133 may include a fixing groove 135 in which the fixing plate 143 is fixed to a front of the protrusion.

The fixing groove 135 may be provided in a center of the front of the protrusion 133.

The fixing plate 143 may include a fixing hole 144 formed to correspond a location of the fixing groove 135 and configured to fix the fixing plate to the fixing groove by the screw S.

The protrusion 133 may further include a fastening hole 134 configured to penetrate the protrusion in a vertical direction to be fastened to the support screw 150. According to the disclosure, when the display 10 is mounted on the wall mount 20, the support screw 150 of the wall mount fixture 100 to which the wall mount is fixed may distribute a load of the display 10, thereby ensuring stability.

The support screw 150 may be fastened to a lower portion of the protrusion 133, and a length of the support screw 150 to be fastened to the fastening hole 134 may be adjusted to allow the first bracket 130 to be supported by a bottom surface of the mounting groove in a state where the first bracket is mounted in the mounting groove 3. According to the disclosure, when the display 10 is mounted on the wall mount 20, the support screw 150 of the wall mount fixture 100 to which the wall mount is fixed may distribute a load of the display 10, thereby ensuring stability.

According to example embodiment of the disclosure, a wall mount fixture to which a wall mount on which a display is mounted is configured to be fixed may include: an extension bracket to which the wall mount is configured to be fixed; a first bracket including a mounting plate mounted into a mounting groove provided on a wall and a protrusion protruding to an outside of the mounting groove on the mounting plate; a second bracket including a receiving portion configured to receive the protrusion and a fixing plate provided in front of the receiving portion to be fixed to the protrusion and to fix the extension bracket; and a support screw configured to be fastened to a lower portion of the protrusion and to support the protrusion inside the mounting groove. According to the disclosure, when the display 10 is mounted on the wall mount 20, the support screw 150 of the wall mount fixture 100 to which the wall mount is fixed may distribute a load of the display 10, thereby ensuring stability.

The effects that may be achieved by the disclosure are not limited to the above-mentioned effects, and other effects not mentioned will be clearly understood by one of ordinary skill in the technical art to which the disclosure belongs from the following description.

Although disclosure has been shown and described in relation to various illustrative example embodiments, it will be appreciated by those skilled in the art that various changes and modifications may be made without departing from the true spirit and full scope of the disclosure, including the appended claims and their equivalents. It will also be understood that any of the embodiment(s) described herein may be used in conjunction with any other embodiment(s) described herein.

What is claimed is:

1. A display apparatus, comprising:

a display;

a wall mount on which the display is configured to be mounted; and a wall mount fixture to which the wall mount is configured to be fixed;

wherein the wall mount fixture comprises:

an extension bracket to which the wall mount is configured to be fixed;

a first bracket including a mounting plate configured to be mounted into a mounting groove provided on a wall and a protrusion protruding from the mounting plate at a first end to a second end configured to be positioned outside of the mounting groove, and the protrusion including a fastening hole that penetrates a lower portion of the protrusion in a vertical direction between the first end and the second end;

a second bracket including a receiving portion configured to receive the protrusion and a fixing plate provided in front of the receiving portion and configured to be fixed to the protrusion and the extension bracket; and a support screw configured to be fastened to the protrusion at the fastening hole and a slot of the second bracket to support the protrusion against a bottom surface of the mounting groove.

2. The display apparatus of claim 1, wherein the support screw is movable when fastened to the fastening hole of the protrusion to allow the first bracket to be supported by the bottom surface of the mounting groove when the first bracket is mounted in the mounting groove.

3. The display apparatus of claim 1, wherein the mounting plate has a rectangular shape, and includes a plurality of mounting holes configured to be mounted in the mounting groove by a plurality of screws.

4. The display apparatus of claim 3, wherein each of the mounting holes is positioned at a corner of the mounting plate.

5. The display apparatus of claim 1, wherein the protrusion has a rectangular column shape.

6. The display apparatus of claim 1, wherein the protrusion comprises a fixing groove at a front of the protrusion and configured to receive a first screw to fix the protrusion to the fixing plate.

7. The display apparatus of claim 6, wherein the fixing groove is positioned at a center of the front of the protrusion.

8. The display apparatus of claim 7, wherein the fixing plate has a rectangular shape and includes a fixing hole configured to receive the first screw to fix the protrusion to the fixing plate.

9. The display apparatus of claim 8, wherein the fixing plate consists of one of the fixing hole and the protrusion consists of one of the fixing groove.

10. The display apparatus of claim 8, wherein the fixing plate includes a plurality of extension bracket fixing holes configured receive a plurality of second screws to fix the fixing plate to the extension bracket.

11. The display apparatus of claim 10, wherein each of the extension bracket fixing holes is positioned at a corner of the fixing plate.

12. The display apparatus of claim 1, wherein the receiving portion includes a cut portion configured to allow the support screw to pass at least partly through the receiving portion when the receiving portion is connected to the protrusion.

13. The display apparatus of claim 12, wherein the receiving portion has a rectangular column shape, and the cut portion is in a lower portion of the receiving portion and extends forward and backward.

14. A wall mount fixture for fixing a display and a wall mount to a wall, the wall mount fixture comprising:

an extension bracket configured to be fixed the wall mount;

a first bracket including a mounting plate configured to be mounted into a mounting groove provided on the wall and a protrusion protruding from the mounting plate at a first end to a second end configured to be positioned outside of the mounting groove, and the protrusion including a fastening hole that penetrates a lower portion of the protrusion in a vertical direction between the first end and the second end;

a second bracket including a receiving portion configured to receive the protrusion and a fixing plate provided in front of the receiving portion and configured to be fixed to the protrusion and the extension bracket; and a support screw configured to be fastened to the protrusion at the fastening hole and a slot of the second bracket to support the protrusion against a bottom surface of the mounting groove.

* * * * *